US007908771B2

(12) United States Patent
Foxen et al.

(10) Patent No.: US 7,908,771 B2
(45) Date of Patent: Mar. 22, 2011

(54) REMOVABLE SPAT FOR A SHOE

(75) Inventors: Thomas Foxen, Portland, OR (US); Jonathan Johnsongriffin, Beaverton, OR (US); E. Scott Morris, Beaverton, OR (US); Craig A. Nomi, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 725 days.

(21) Appl. No.: 11/857,265

(22) Filed: Sep. 18, 2007

(65) Prior Publication Data

US 2009/0071037 A1 Mar. 19, 2009

(51) Int. Cl.
*A43B 7/20* (2006.01)
*A61F 13/00* (2006.01)

(52) U.S. Cl. ..... 36/89; 36/100; 36/88; 36/128; 602/27; 602/65; D24/192

(58) Field of Classification Search ..... 36/88, 89, 36/100, 128, 7.2, 132; 602/27, 23, 65, 66; D24/192
See application file for complete search history.

(56) References Cited

U.S. PATENT DOCUMENTS

| | | | | |
|---|---|---|---|---|
| 459,616 | A | 9/1891 | Von Rohonczy | |
| 1,820,679 | A | 8/1931 | Sawyer | |
| 3,875,687 | A * | 4/1975 | Henderson | 36/7.1 R |
| 4,177,583 | A * | 12/1979 | Chapman | 36/77 R |
| 4,314,412 | A | 2/1982 | Anderson et al. | |
| 4,461,288 | A | 7/1984 | Curtis | |
| 4,649,939 | A | 3/1987 | Curtis | |
| 4,665,633 | A * | 5/1987 | Edgerton | 36/2 R |
| 5,016,623 | A | 5/1991 | Krahenbuhl | |
| 5,050,620 | A | 9/1991 | Cooper | |
| 5,566,476 | A | 10/1996 | Bertrand et al. | |
| D385,102 | S | 10/1997 | Avar | |
| 5,694,703 | A | 12/1997 | Diaz | |
| 5,704,140 | A | 1/1998 | Fields | |
| 5,778,565 | A * | 7/1998 | Holt et al. | 36/110 |
| 5,782,727 | A | 7/1998 | Pierce | |
| 5,822,887 | A | 10/1998 | Turner | |
| 5,926,978 | A * | 7/1999 | Smith | 36/101 |
| 5,987,778 | A | 11/1999 | Stoner | |
| 6,117,098 | A | 9/2000 | Weber et al. | |
| 6,126,627 | A | 10/2000 | Brennan | |
| 6,212,797 | B1 | 4/2001 | Merry et al. | |
| 6,272,771 | B1 * | 8/2001 | Rodi | 36/77 R |
| D455,836 | S * | 4/2002 | Lammers | D24/192 |
| 6,866,043 | B1 * | 3/2005 | Davis | 128/842 |
| 7,082,703 | B2 | 8/2006 | Greene et al. | |
| 7,296,367 | B2 * | 11/2007 | Kipnes | 36/94 |
| 2006/0201032 | A1 | 9/2006 | Ramsey | |

* cited by examiner

*Primary Examiner* — Jila M Mohandesi
(74) *Attorney, Agent, or Firm* — Banner & Witcoff, Ltd.

(57) ABSTRACT

A removable spat may be used with a shoe having a sole and an upper. The spat includes a boot portion having a back opening and a front end, and a sleeve connected to the boot portion. The back opening of the boot portion is adapted to receive the shoe therein. The sleeve has a fixed end connected to the front end of the boot portion and a free end opposite the fixed end. The sleeve extends freely from the front end to define a first sleeve position, and the sleeve is foldable over the boot portion to define a second sleeve position.

25 Claims, 15 Drawing Sheets

REMOVABLE SPAT FOR A SHOE

TECHNICAL FIELD

The invention relates generally to athletic support equipment, and more particularly, to a removable spat for use with an athletic shoe or other footwear.

BACKGROUND OF THE INVENTION

A variety of athletic support equipment currently exists for use in many different applications. Athletes, such as football players, often require ankle and foot support, for example, to help prevent injuries to the ankle and to help reduce pain from and/or aggravating previous injuries. In many situations, an athlete or a trainer may apply athletic tape to the athlete's foot and ankle to provide this support. However, the taping technique creates several disadvantages. For example, taping the ankles requires significant time, and the tightness of the tape is not adjustable once applied. In addition, taping may still lack the desired tightness and support an athlete desires. As another example, the tape does not provide an aesthetically pleasing look, and it may obscure logos and team colors on the shoe over which the tape is applied. Other athletic support equipment for use in the foot and ankle area may suffer from these or other disadvantages.

The present apparatus is provided to solve the problems discussed above and other problems, and to provide advantages and aspects not provided by prior apparatuses and methods of this type. A full discussion of the features and advantages of the present invention is deferred to the following detailed description, which proceeds with reference to the accompanying drawings.

SUMMARY OF THE INVENTION

The following presents a general summary of aspects of the invention in order to provide a basic understanding of at least some of its aspects. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to a removable spat that may be used with a shoe having a sole and an upper. The spat includes a boot portion having a back opening and a front end, and a sleeve connected to the boot portion. The back opening of the boot portion is adapted to receive the shoe therein. The sleeve has a fixed end connected to the front end of the boot portion and a free end opposite the fixed end. The sleeve extends freely from the front end to define a first sleeve position, and the sleeve is foldable over the boot portion to define a second sleeve position.

According to one aspect, the boot portion includes first, second, and third straps. The first strap is releasably fastenable laterally across the back opening and around a heel of the shoe when the shoe is adapted to be received in the boot portion. The second strap is releasably fastenable around a top of the boot portion. The third strap is releasably fastenable from a bottom of the boot portion vertically over the back opening and across a portion of the sole of the shoe when the shoe is adapted to be received in the boot portion.

According to another aspect, the sleeve has a first opening and a second opening therein, wherein when the sleeve is in the second position, an upper portion of the boot portion extends through the first opening, and the second opening is adapted to receive a cleat of the shoe sole therethrough.

According to another aspect, the spat also includes a band connected to the boot portion. The band is releasably fastenable around the boot portion to provide compression thereto.

According to another aspect, the band may be releasably fastened around a portion of the boot portion to provide compression thereto.

According to further aspects, the sleeve may be customizable. For example, the sleeve may be made of a waterproof material, a dirt-resistant material, or a breathable material, the sleeve may have a textural coating on at least a portion thereof, the sleeve may have a reflective portion, the sleeve may have an insulation material, and the sleeve may have indicia thereon that is visible when the sleeve is in the second position.

Other aspects of the invention relate to a removable spat that may be used with a shoe having a sole and an upper. The spat includes a boot portion and a sleeve attached to the boot portion. The boot portion has a front opening and is adapted to wrap around a portion of the shoe to fasten the spat to the shoe such that a toe portion of the shoe extends through the front opening. The sleeve has a fixed end attached to the boot portion and a free end not attached to the boot portion. Additionally, the sleeve is foldable from a first position, where the free end of the sleeve extends outwardly from the boot portion, to a second position, where the sleeve is folded to wrap the sleeve around the boot portion and cover a portion of the boot portion.

According to one aspect, the fixed end of the sleeve is attached to the boot portion around the front opening.

According to another aspect, the sleeve has a first opening and a second opening therein. When the sleeve is in the second position, an upper portion of the boot portion extends through the first opening, and the second opening is adapted to receive a cleat of the shoe sole therethrough.

According to another aspect, the boot portion has an opening at a bottom thereof, wherein the opening is adapted to receive a cleat of the shoe sole therethrough, and the sleeve has an opening therein, wherein when the sleeve is in the second position, the sleeve opening is substantially aligned with the opening of the boot portion and is adapted to receive the cleat of the shoe sole therethrough.

Additional aspects of the invention relate to a removable spat that may be used with a shoe having a sole and an upper. The spat includes a bottom portion adapted to cover a portion of the sole of the shoe and a boot portion connected to the bottom portion. The bottom portion has an opening adapted to receive a cleat of the sole, permitting the cleat to pass through the bottom portion. The boot portion is adapted to wrap around a portion of the shoe upper to fasten the spat to the shoe.

According to one aspect, the bottom portion is adapted to cover at least a portion of an area between two cleats on the sole of the shoe.

According to another aspect, the bottom portion has a plurality of openings, each opening adapted to receive one of a plurality of cleats of the sole.

According to another aspect, the boot portion has a plurality of straps adapted to wrap around a portion of the shoe upper and a portion of a leg of a user wearing the shoe.

According to another aspect, at least a portion of the bottom portion has a wear resistant coating thereon.

Further aspects of the invention relate to a removable spat that may be used with a shoe having a sole and an upper. The spat includes a bottom portion adapted to cover a portion of the sole of the shoe, and a forefoot strap and a rear strap adapted to fasten the spat to the shoe. The forefoot strap is connected to the bottom portion and has a pair of end portions adapted to wrap around a rear of the shoe and fasten to each other proximate the rear of the shoe. The forefoot strap covers at least a portion of a forefoot portion of the shoe upper. The rear strap is connected to the bottom portion and has a pair of end portions adapted to fasten to each other such that the rear strap wraps around the forefoot strap. The rear strap covers the end portions of the forefoot strap at a point where the end portions of the forefoot strap fasten to each other.

According to one aspect, the spat further includes a rigid reinforcing member held in place by at least one of the forefoot strap and the rear strap. In one embodiment, the rigid reinforcing member is a carbon fiber shaft received within a pocket in the forefoot strap.

According to another aspect, the forefoot strap has a stirrup configuration, defining an opening between the forefoot strap and the bottom portion, wherein the shoe is adapted to be received through the opening.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
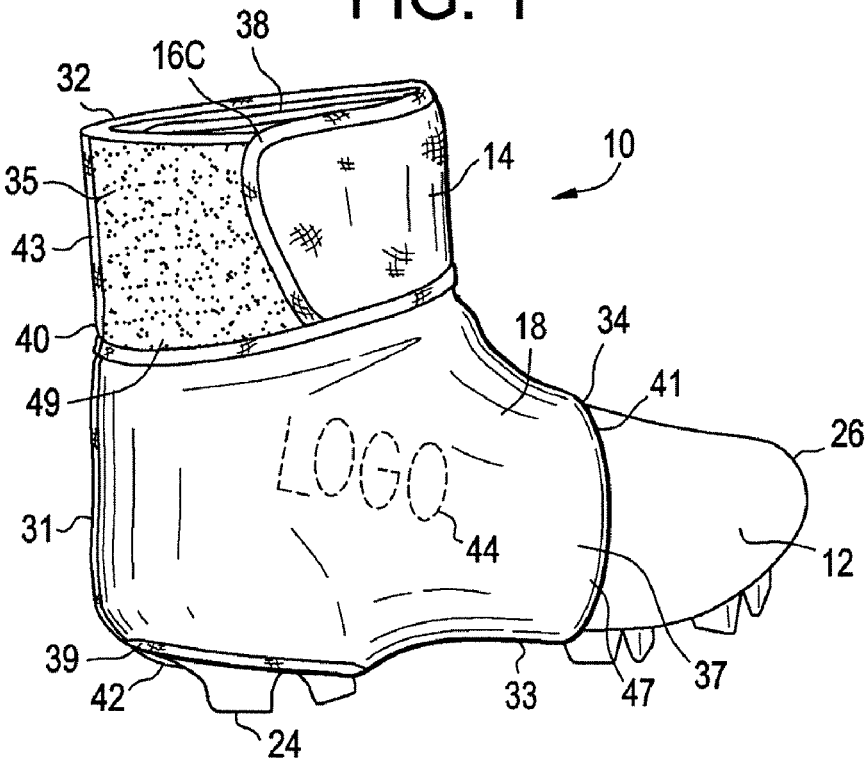
FIG. 1 is a perspective view of one embodiment of a removable spat, shown fastened to a shoe.

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "rear," "side," "vertical," "lateral," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

Referring initially to FIGS. 1-8, a first embodiment of a removable spat 10 is shown. The spat 10 generally includes a boot portion 14 with a plurality of releasably fastenable straps 16 and a sleeve portion 18. The spat 10 is fastenable around a shoe 12 in order to provide compression and support to the foot, ankle, and lower leg of a user wearing the shoe 12. Generally, the spat 10 has an open configuration, shown in FIG. 4, where the shoe 12 may be inserted into the spat 10, and a closed configuration, shown in FIG. 1, where the spat 10 is fastened around the shoe 12 to provide compression. The fastening of the spat 10 to the shoe 12 is described in greater detail below.

The shoe 12 illustrated in FIGS. 1-8 is a football shoe, having a sole 20 and an upper 22, with a plurality of cleats 24 protruding from the sole 20. The exemplary embodiment of the spat 10 shown in FIGS. 1-8 is suitable for use with such a football shoe 12. However, the spat 10 may also be used with a different type of shoe, and other embodiments of the spat 10 may be suitable for use with a wide variety of different shoes or other types of footwear, such as soccer cleats, baseball/softball cleats, basketball shoes, running shoes, etc.

Figure 3:
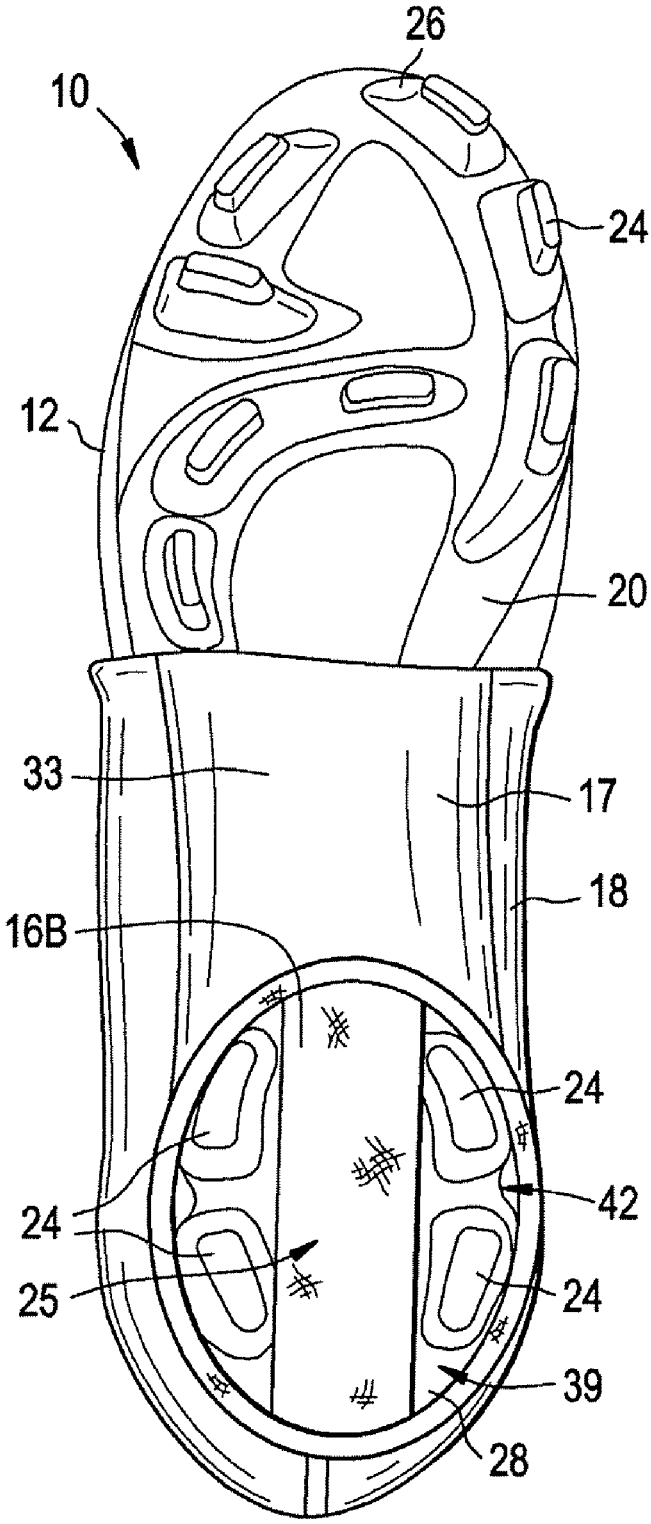
FIG. 3 is a bottom view of the spat and shoe of FIG. 1.
Figure 4:
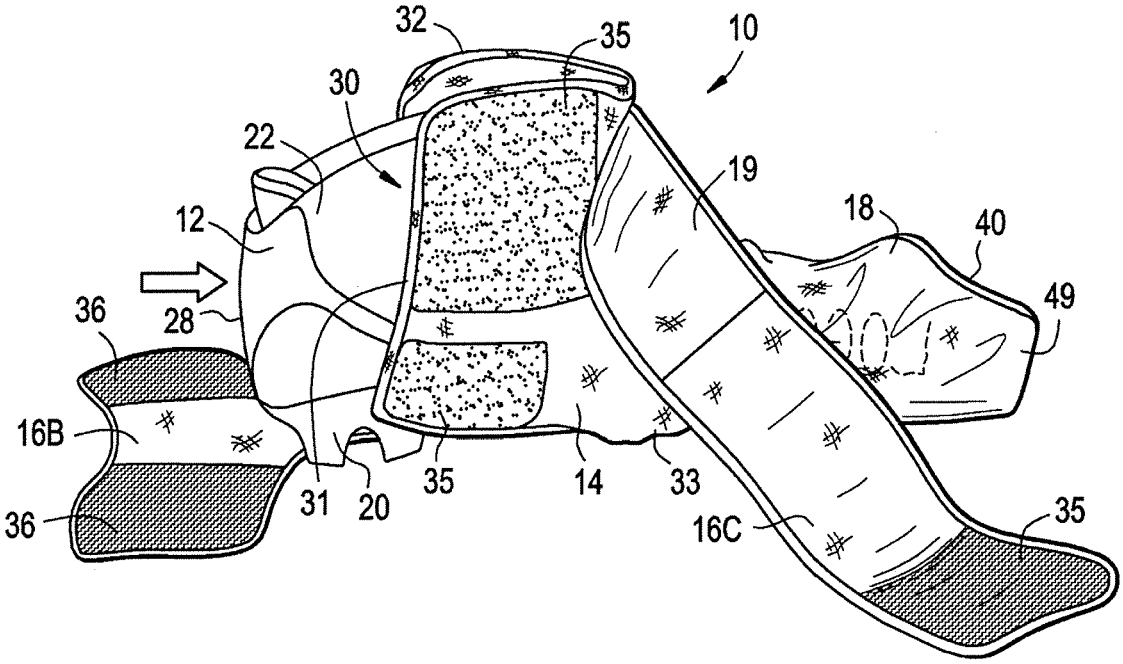
FIG. 4 is a side view of the spat and shoe of FIG. 1, showing the shoe being inserted into the spat.
Figure 5:
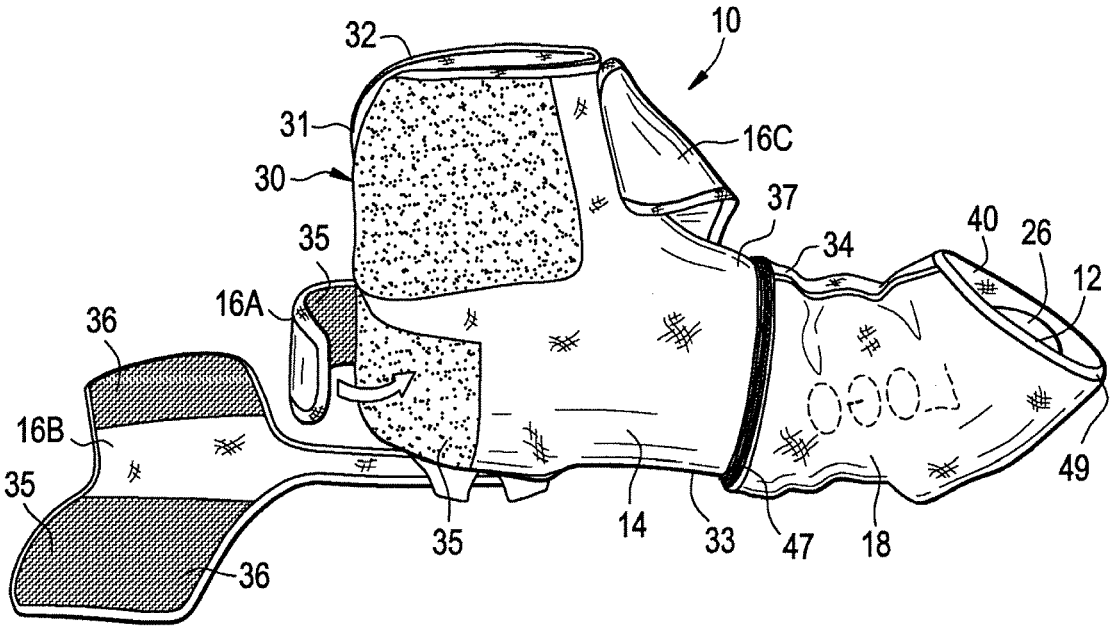
FIG. 5 is a side view of the spat and shoe of FIG. 1, showing steps in a process of fastening the spat to the shoe.
Figure 6:
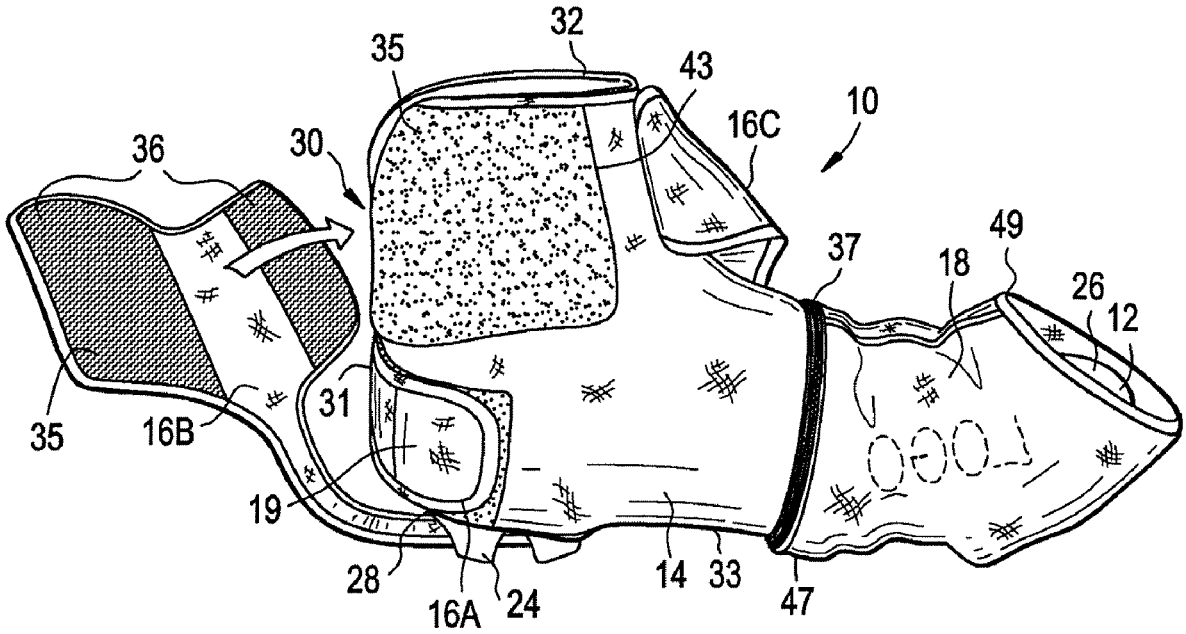
FIG. 6 is a side view of the spat and shoe of FIG. 1, showing further steps in the process of fastening the spat to the shoe.

The boot portion 14 is generally adapted to receive the shoe 12 therein. When the spat is in the open configuration, shown in FIG. 4, the boot portion 14 has a rear opening or back opening 30 adapted to receive the shoe 12 therein. In the embodiment illustrated, the rear opening 30 extends across the entire rear 31 of the boot portion 14, as well as over a portion of the top 32 and bottom portion 33 of the boot portion 14. The size of the rear opening 30 allows the shoe 12 to be easily inserted into the boot portion 14, as shown in FIG. 4, which is even more beneficial when the user is wearing gloves, as athletes sometimes do. Alternatively, the boot portion 14 can have a more closed configuration wherein the rear opening 30 is eliminated (e.g., the shoe 12 may be inserted through the ankle openings or top portion 32). The boot portion 14 of this illustrated example structure 10 also has a front opening 34, and the toe portion 26 of the shoe 12 protrudes from the front opening 34 when the spat 10 is fastened to the shoe 12, as shown in FIGS. 5-6. The boot portion 14 is releasably fastened to the shoe 12 by one or more releasably fastenable straps 16 that wrap around the shoe 12 to hold the spat 10 to the shoe 12. Generally, after wrapping, the straps 16 may be fastened in place in a variety of different manners. In the exemplary embodiment shown in FIGS. 1-8, hook and loop fastener portions 35 (such as Velcro) are positioned on the surfaces of the straps 16, as well as various locations on the boot portion 14 where the straps 16 may be fastened, for the purpose of fastening the straps 16. In other embodiments, other means and structures for fastening the straps 16 may be used, including, for example, clasps, buttons, snaps, hooks, buckles, adhesives, and other known means and structures.

Figure 7:
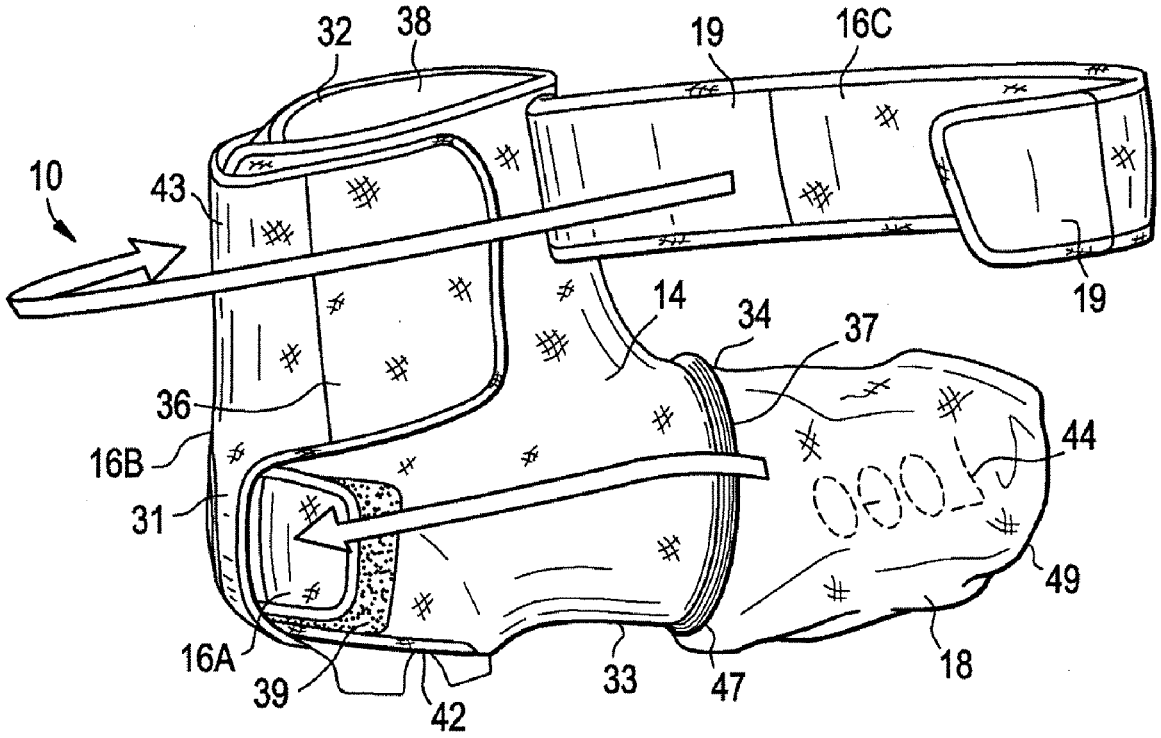
FIG. 7 is a side view of the spat and shoe of FIG. 1, showing further steps in the process of fastening the spat to the shoe.

As shown in FIGS. 1-8, the boot portion 14 has three straps 16A, 16B, and 16C, for fastening the spat 10 to the shoe 12. A first strap 16A, or rear strap, is fastenable laterally around the heel 28 of the shoe 12 and across the rear opening 30. A second strap 16B, or bottom strap, extends across a portion of the sole 20 of the shoe 12 and vertically up the heel 28 of the shoe 12 where it is fastenable to the sides of the boot portion 14. In the embodiment shown, the second strap 16B is relatively narrow near its tethered end and has a widened portion at the free end, having wings 36 extending outwardly. When fastened, these wings 36 extend laterally across the heel 28 or ankle area of the shoe 12 and across the rear opening 30, as seen in FIG. 7. A third strap 16C, or top strap, is fastenable around the top 32 of the boot portion 14 and around the high ankle area of the shoe 12. Depending on the configuration of the shoe 12, the top strap 16C may also extend around the high ankle and lower leg area of a user wearing the shoe. The straps 16, when fastened, can apply pressure to the spat 10 and the shoe 12 to hold the spat 10 securely on the shoe 12 and to provide compression to the ankle and surrounding area. The connection and fastening of the straps 16 is described in greater detail below.

The boot portion 14 may be manufactured from one of a variety of different suitable materials known in the art. In one exemplary embodiment, the boot portion 14 is manufactured from an elastic neoprene material. Such a material provides suitable elasticity and strength, and may be wrapped easily to provide controllable compression to the foot, leg, and ankle of the user. In the embodiment illustrated in FIGS. 1-8, the boot portion 14 is a single connected piece made of several separate pieces of material sewn together. However, in other embodiments, the boot portion 14 may be made of multiple pieces, or may be a single, integral piece. Additionally, the boot portion 14 may contain structure for providing localized strength, support, and rigidity. In the embodiment shown in FIGS. 1-8, the rear strap 16A and the top strap 16C have patches 19 of low-stretch material sewn onto the straps 16A, 16C to prevent stretching in those areas. As a result, most of the stretching of the straps 16A, 16C occurs in the areas of the straps 16A, 16C that do not have such patches 19. In another embodiment, additional stitching may be added in certain areas to provide increased strength and decreased elasticity. Further, the different straps 16 of the boot portion 14 may be made of different materials, to give each strap 16 certain desired properties for optimum performance. For example, in one embodiment, the bottom strap 16B contains a low-stretch material, in order to provide greater tightness and compression in the area. In the embodiment illustrated in FIGS. 1-8, the bottom strap 16B is made of neoprene, having a strip of low-stretch material (not shown) sewn thereon over the length of the neoprene strap 16B, to limit stretching of the strap 16B. In another example, the bottom strap 16B may contain a more wear-resistant material, since the bottom strap 16B may contact the ground often during movement.

Figure 8:
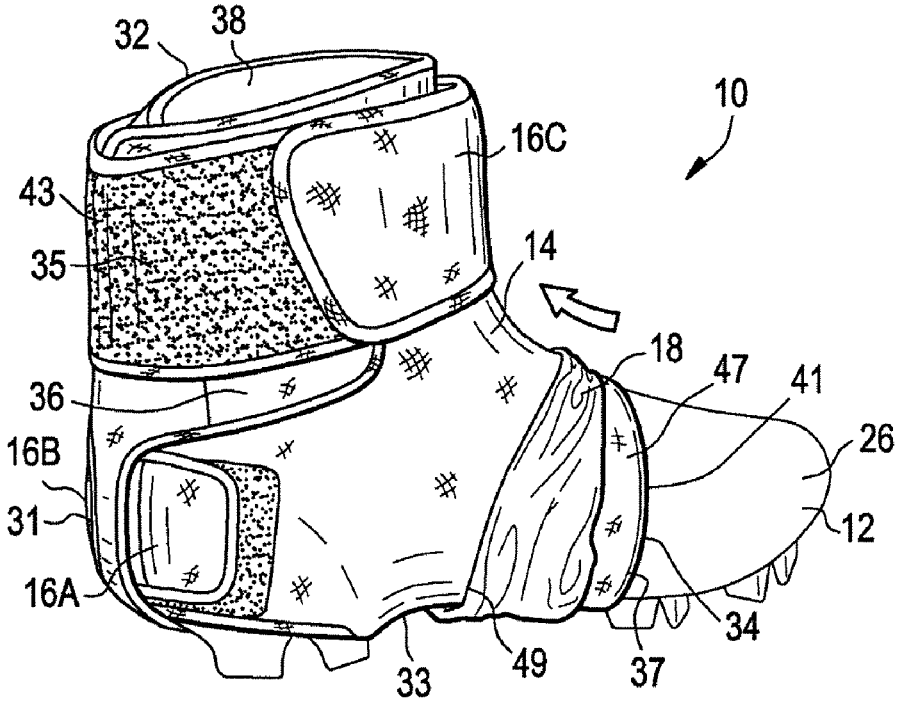
FIG. 8 is a side view of the spat and shoe of FIG. 1, showing a sleeve being folded backward over the shoe.

In the embodiment of FIGS. 1-8, the sleeve 18 has a fixed end 47 that is sewn or otherwise connected to the boot portion 14 around the front opening 34 of the boot portion 14, and a free end 49 that is not directly connected to the boot portion 14. The sleeve 18 is moveable between a first, free position or configuration, and a second, secured position or configuration. In the free position, shown in FIGS. 4-7, the free end 49 of the sleeve 18 extends freely and outwardly from the front 37 of the boot portion 14 around the front opening 34. In the secured position, shown in FIG. 1, the free end 49 of the sleeve 18 is folded backwards around the heel 28 of the shoe 12 and the rear 31 of the boot portion 14. The movement of the sleeve 18 is shown in FIG. 8 and described in greater detail below. The sleeve has two openings 40, 42, which are referenced as a top opening 40 and a bottom opening 42 in FIG. 1. In the secured sleeve position, an upper portion 43 of the boot portion 14 extends through the top opening 40, and the bottom opening 42 is located proximate the heel area of the sole 20 of the shoe 12. Additionally, the sleeve 18 has a front opening 41 that receives the toe 26 of the shoe 12 therethrough, and which is generally contiguous with the front opening 34 of the boot portion 14.

The sleeve 18 may be manufactured from one of a variety of different suitable materials known in the art. In one exemplary embodiment, the sleeve 18 is manufactured from a lycra material that provides suitable elasticity and strength. The sleeve 18 may have indicia 44 thereon, for example, the logo of the manufacturer of the spat 10, a player name or number, team graphics, colors etc., and such indicia may be formed on the sleeve by sewing, stitching, screening, or other known techniques. In some embodiments, such as the embodiment of FIGS. 1-8, the indicia 44 may be positioned to be visible when the sleeve 18 is folded backward on the boot portion 14, to be visible during use. However, as shown in FIGS. 4-6, the indicia 44 may be visible in other sleeve positions as well. It is understood that indicia may be located on any desired portions of the spat 10 in other embodiments.

Additionally, in some embodiments, the sleeve 18 may include customized aspects, such as a functional coating or other customized feature. In one example, the sleeve 18 may be color-customized, such as to display team colors. One user may have several spats 10 having sleeves 18 of different colors, allowing for a user to wear differently colored spats in different situations, for example, home and away game situations or practice situations. In another example, the sleeve 18 may have a surface, or a portion thereof, that is textured in order to increase the durability of the sleeve 18. In another example, the sleeve 18 may have a reflective coating or element thereon, to provide greater visibility during night games, which may be provided on or around the indicia 44 in some embodiments. In another example, the sleeve 18 may contain a waterproof material to waterproof the sleeve 18, which may include a waterproof coating. In another example, the sleeve 18 may contain a mud or dirt resistant material, which may be in the form of a coating. In another example, the sleeve 18 may contain a breathable material, which may contain perforations or other such structures enhancing breathability. In another example, the sleeve 18 may contain an abrasion resistant material, which may be in the form of a coating. The abrasion resistant properties may be obtained by using a "diamond plate" surface pattern, having diamond-shaped raised portions of the material. As illustrated in FIG. 3, the bottom of the sleeve 18 of the embodiment shown has a film 17 applied thereto, to provide durability and abrasion resistance in the area of the sleeve 18 that contacts the ground often during running, further enhancing the performance of the spat 10 and therefore the athlete wearing the spat 10. In another example, the sleeve 18 may include strategically-placed stitching to increase strength and decrease elasticity in desired areas, as well as other strength-enhancing features. In another example, the sleeve 18 may be adapted for warm or cold weather, such as being thinner and more breathable for warm weather or having insulation material to insulate the shoe 12 for cold weather. Still other enhanced features may be incorporated into the sleeve 18 in other embodiments.

In the exemplary embodiment illustrated in FIGS. 1-8, fastening the spat 10 to the shoe 12 is done by first inserting the shoe 12 (typically while worn on the foot of the user) into the rear opening 30 of the boot portion 14, as shown in FIG. 4. As the shoe 12 is inserted into the boot portion 14, the toe 26 of the shoe 12 protrudes from the front opening 34, as shown in FIG. 5. Once the shoe 12 is fully inserted, the rear strap 16A is pulled across the heel 28 of the shoe 12 and across the rear opening 30, and fastened to the hook and loop fastener portion 35 located on the opposite side of the rear opening 30, as shown in FIG. 5. The rear strap 16A (as well as the other straps 16B, 16C) can be pulled to a desired tightness to provide a desired level of compression and support to the foot of the user. The bottom strap 16B is then pulled across a portion of the sole 20 of the shoe 12 and up the heel 26 of the shoe, aligned with the rear opening 30, as shown in FIG. 6. Once the bottom strap 16B is pulled to the desired tightness, the wings 36 are fastened to the hook and loop fastener portions 35 located on adjacent opposed sides of the rear opening 30. Next, the top strap 16C is wrapped around the top 32 of the boot portion 14, pulled to the desired tightness, and fastened to the hook and loop fastener portion 35 located on the outer surface of the top strap 16C, as shown in FIG. 7. In one embodiment, the straps 16 may include indicia (not shown) thereon, such as color-coding, numbering, or other instructions, to assist a user in fastening the spat 10 on the shoe 12. For example, the indicia may indicate where each strap 16 may be fastened and the order in which the straps 16 should be fastened. Logos or other decorative indicia also may be provided on the strap(s) 16.

While the straps 16 are being fastened in place, the sleeve 18 is in the first or free position, shown in FIGS. 4-7, so that the sleeve 18 does not interfere with the fastening of the straps 16. It is understood that the sleeve 18 may be partially pulled back on the shoe 12 and/or spat 10, and still be considered to be in the first or free position. Once the straps 16 have all been fastened to the desired levels of tightness, the free end 49 of the sleeve 18 is pulled backward over the shoe 12 and the spat 10, as shown in FIG. 8. In the embodiment shown, the sleeve 18 is turned inside-out as it is being pulled backward. Thus, the sleeve 18 is foldable from or movable from the first position to the second position Eventually, the sleeve 18 is pulled backward over the heel 28 of the shoe 18 and the rear 31 of the boot portion 14, to the second or secured position, illustrated in FIG. 1. The top opening 40 of the sleeve 18 extends around the upper portion 43 of the boot portion 14, which protrudes out of the top opening 40 when the sleeve 18 is in the secured position. In the secured position, the sleeve 18 covers most of the free ends and releasable connections of the straps 16, helping to prevent the connections from being unintentionally released, such as through contact.

When the spat 10 is fully fastened to the shoe 12, the boot portion 14 has a top opening 38 at the top 32 of the boot portion 14 and a bottom opening 39 on the bottom portion 33 of the boot portion 14. The leg of the user (not shown) extends upward out of top opening 38 of the boot portion 14 in this configuration. The bottom opening 39 uncovers the rear cleats 24 on the heel 28 of the sole 20 of the shoe 12, allowing the cleats 24 to pass through the bottom portion 33 of the boot portion 14 and contact the ground, as illustrated in FIGS. 1 and 3. Additionally, the bottom opening 42 of the sleeve 18 is substantially aligned with the bottom opening 39 of the boot portion 14, allowing the cleats 24 to pass completely through the bottom of the spat 10. Further, as shown in FIG. 3, the bottom strap 16B extends across the heel of the sole 20, through spaces 25 between the cleats 24. This configuration of the bottom strap 16B helps to hold the spat 10 more securely to the shoe 12. Further, the toe 26 of the shoe 12 protrudes from the front opening 34 of the boot portion 14 and the front opening 41 of the sleeve 18. As shown in FIGS. 1 and 3, the front 37 of the boot portion 14 stops short of the front cleats 24 on the toe 26 of the shoe, and does not interfere with contact between the cleats 24 and the ground.

Figure 2:
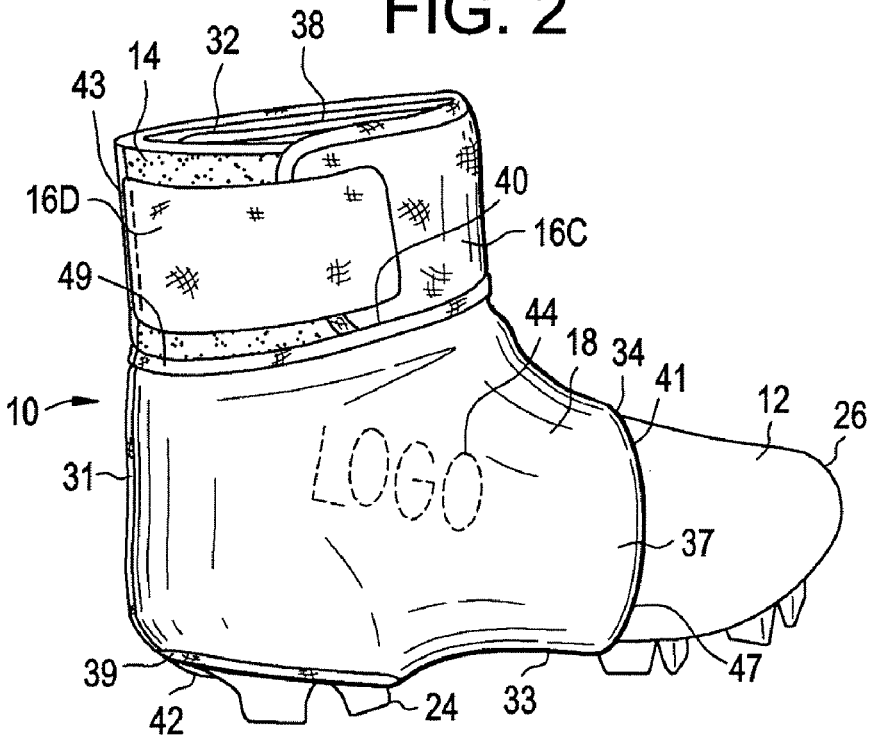
FIG. 2 is a perspective view of the spat and shoe of FIG. 1, the spat having an additional strap attached thereto.

In some embodiments, the spat 10 may include additional features to further cover and protect the free ends of the straps 16 and the releasable connections, and to prevent the connections from becoming unintentionally released, such as through contact. FIG. 2 illustrates one such embodiment, where the spat 10 further includes an additional strap 16D attached to the outer surface of the top strap 16C proximate the hook and loop fastener portion 35. The strap 16D is in reverse orientation to the free end of the top strap 16C, and can be fastened backward over the free end of the top strap 16C, in order to help prevent the top strap 16C from becoming loosened or unfastened during use. This strap 16D also may provide additional support for the foot or ankle. In another embodiment (not shown), the sleeve 18 may cover a larger amount of the boot portion 14, such as by extending farther up the boot portion 14, proximate the top 32 of the boot portion 14. This larger sleeve (not shown) covers the free end of the top strap 16C, to help prevent the top strap 16C from becoming loosened or unfastened during use.

Referring to FIGS. 9-12, a second embodiment of a removable spat 110 for use with a shoe 12 is shown. The spat 110 contains many features similar to the features of the spat 10 described above and shown in FIGS. 1-8, and such similar features are similarly referred to using the "100" series of reference numerals. Accordingly, the similar features of the spat 110 are only briefly described herein, and the spat 110 is described in greater detail with respect to the differences from the spat 10 previously described. The shoe 12 shown in FIGS. 9-12 is considered to be similar to the shoe 12 described above, and the features of the shoe 12 are referred to in the same manner.

As described above, the exemplary embodiment of the spat 110 illustrated in FIGS. 9-12 has a boot portion 114 that includes a plurality of straps 116 and a sleeve 118 connected to the boot portion 114. The boot portion 114 includes a rear strap 116A, a bottom strap 116B, and a top strap 116C, as well as various hook and loop fastener portions 135 for releasably fastening the straps 116. It can be observed from the drawings that in the embodiment of FIGS. 9-12, the rear strap 116A is larger and wider than the rear strap 16A of the spat 10 of FIGS. 1-8. Additionally, the bottom strap 116B is narrower than the bottom strap 16B of the spat 10 of FIGS. 1-8, and does not contain a widened portion or wings 36. The top strap 116C generally has a similar configuration as the top strap 16C described previously. The sleeve 118 also has a similar configuration as the sleeve 18 described previously, being attached to the front 137 of the boot portion 114 around the front opening 134 thereof.

In the exemplary embodiment of FIGS. 9-12, the spat 110 also includes an additional strap, in the form of a separable band 150 that wraps around the boot portion 114 to provide additional compression to the spat 110. In one embodiment, the band 150 is made of a low-stretch, high-strength material to provide greater compression and stability. The band 150 shown in FIGS. 9-12 includes hook and loop fastener portions 135 at the free ends 152 for fastening the free ends 152 to the boot portion 114, as well as a hook and loop fastener portion 135 proximate the midpoint 154 of the band 150 for fastening the middle 154 of the band 150 to the bottom strap 116B proximate the heel 28 of the shoe 12. The band 150 further has material loops 156 sewn onto the free ends 152, to permit a user to grip the band 150 and pull the band 150 tighter, for achieving greater compression. The boot portion 114 has a loop 158 proximate the front opening 134, and the free ends 152 of the band 150 can be threaded through the loop 158 to hold the band 150 in place after wrapping.

Figure 9:
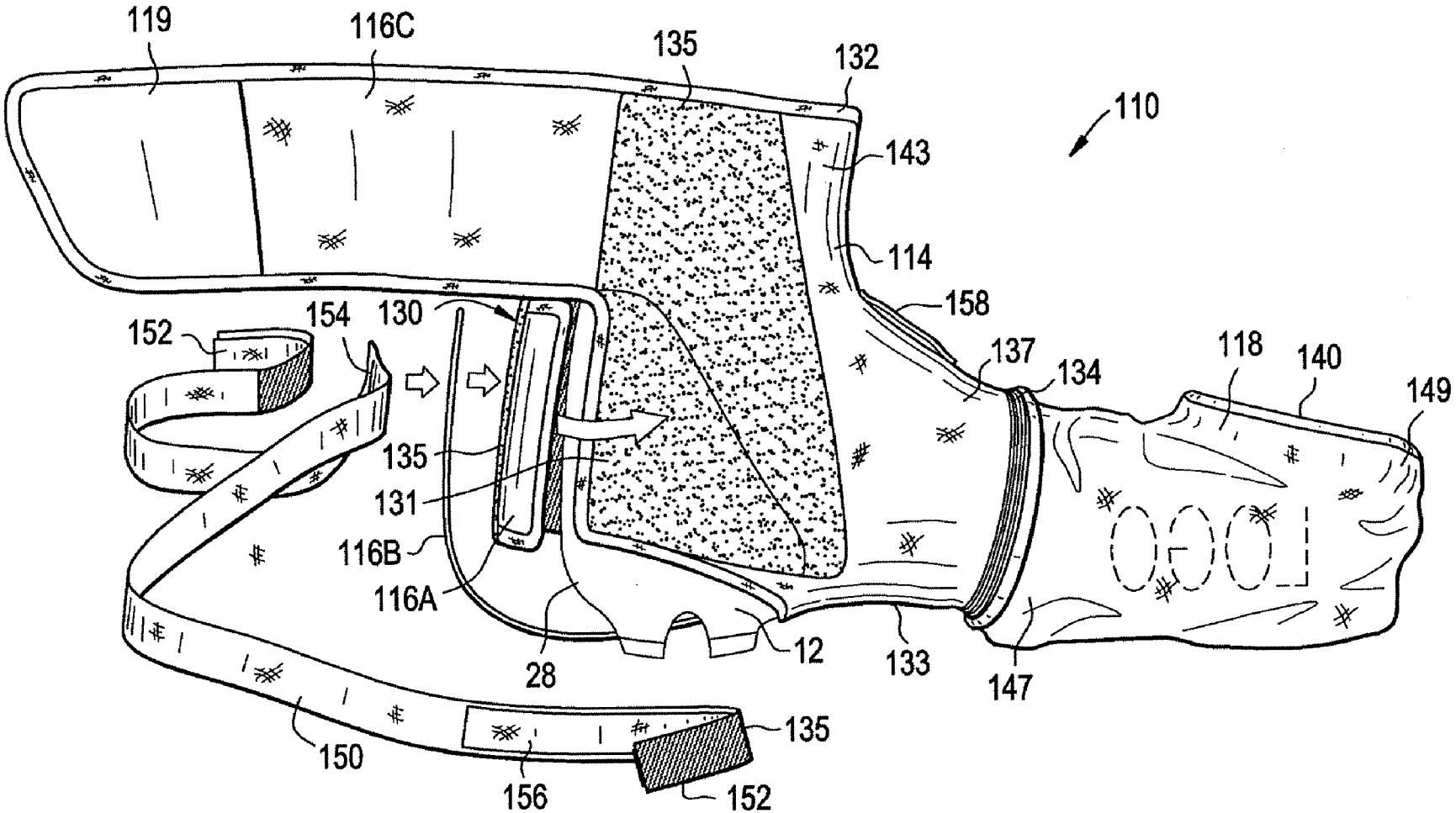
FIG. 9 is a side view of a second embodiment of a removable spat, showing steps in a process of fastening the spat to a shoe.
Figure 10:
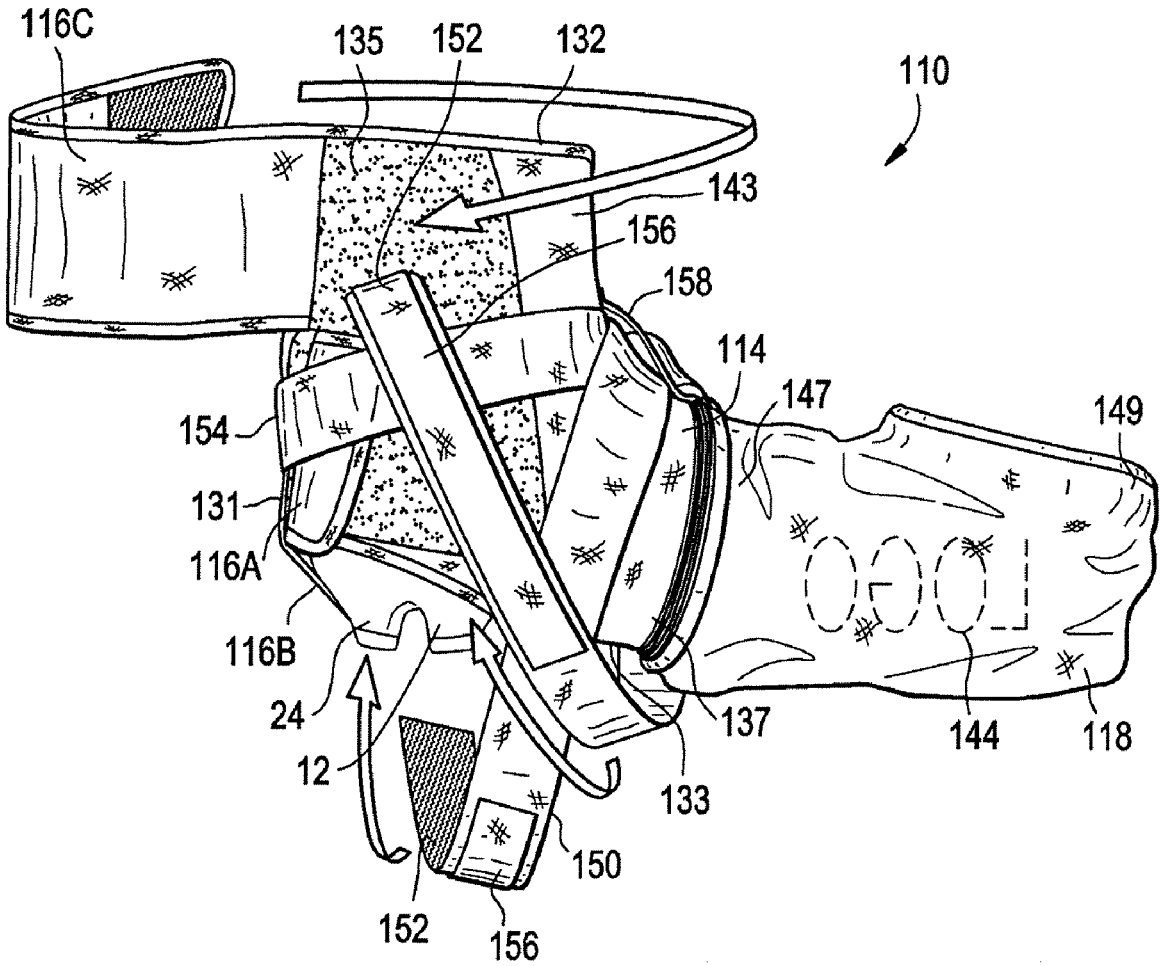
FIG. 10 is a side view of the spat and shoe of FIG. 9, showing further steps in the process of fastening the spat to the shoe.
Figure 11:
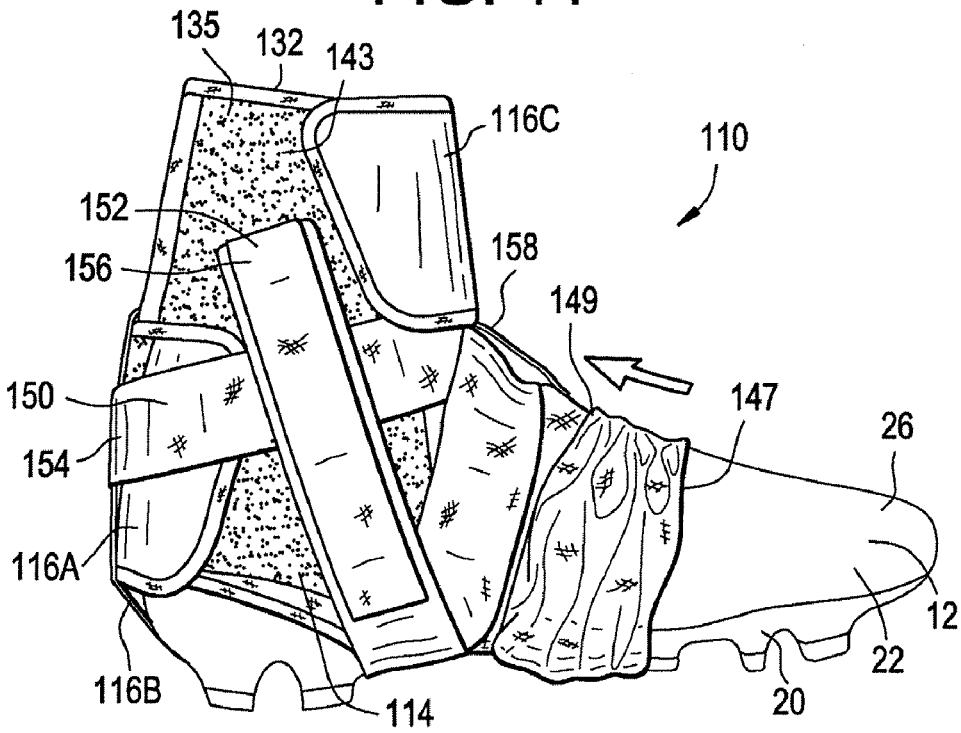
FIG. 11 is a side view of the spat and shoe of FIG. 9, showing a sleeve being folded backward over the shoe.

The spat 10 is fastened to the shoe 12 in a manner similar to that described above with respect to the spat 10 of FIGS. 1-8. First, the shoe 12 is inserted into the rear opening 130 of the boot portion 114, as shown in FIG. 9, and the toe 26 of the shoe 12 protrudes from the front opening 134. As shown in FIG. 9, the rear strap 116A is then fastened across the heel 28 of the shoe 12 and across the rear opening 130 of the boot portion 114. The bottom strap 116B is pulled across the sole 20 of the shoe 12 and vertically up the rear opening 130 and up the heel 28 of the shoe 20, and is fastened to the rear strap 116A, as also shown in FIG. 9. Like the bottom strap 16B described above and shown in FIG. 3, the bottom strap 116B extends through the spaces 25 between the cleats 24 on the sole 20 of the shoe 12. After the rear strap 116A and bottom strap 116B are fastened, the band 150 is wrapped around the boot portion 114. As shown in FIGS. 10-11, the midpoint 154 of the band 150 is fastened to the bottom strap 116B proximate the heel 28 of the shoe 12, and the free ends 152 are threaded through the loop 158 at the front 137 of the boot portion 114. The free ends 152 are then wrapped around the bottom portion 133 of the boot portion 114 and up the sides of the boot portion 114, where the free ends 152 are fastened, as shown in FIGS. 10-11. The configuration of the band 150 may provide similar compressive forces and feel of a traditional taping configuration recognized by athletes. The top strap 116C is then wrapped around the top 132 of the boot portion 114 and is fastened upon itself, in the same manner as described above. After the straps 116, 150 have been wrapped to the desired tightness and fastened, the free end 149 of the sleeve 118 is pulled backward over the boot portion 114, as shown in FIGS. 11-12, in the same manner as described above.

Figure 12:
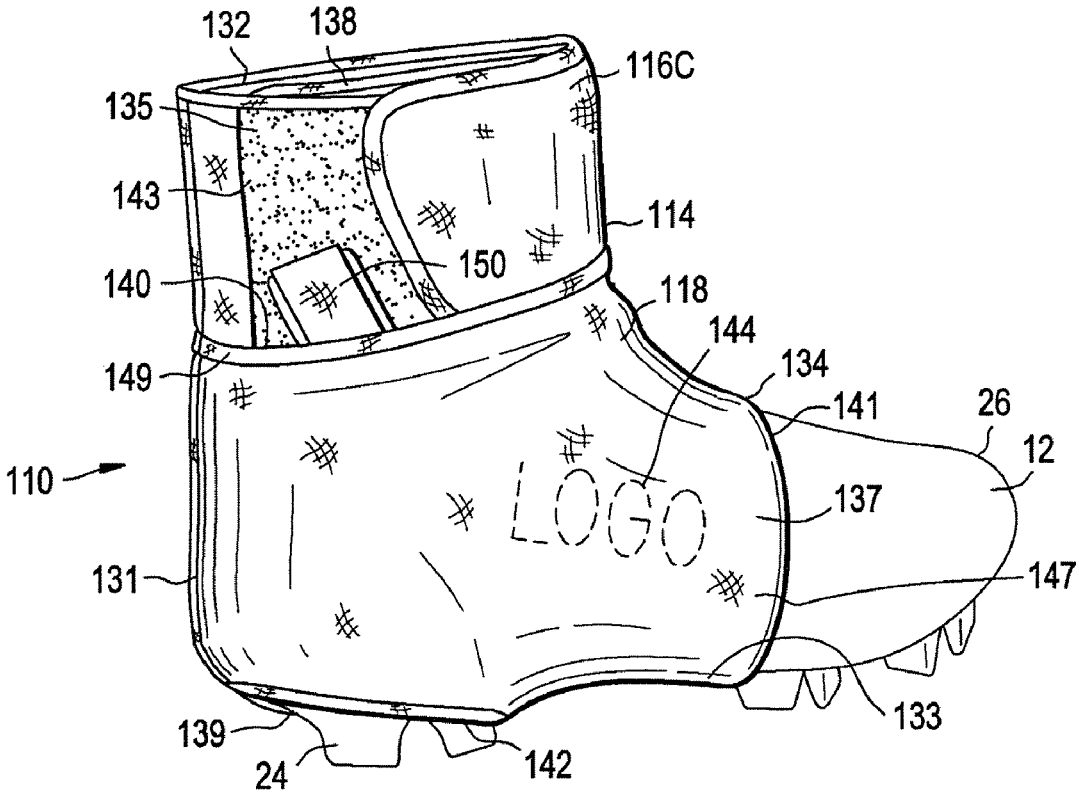
FIG. 12 is a side view of the spat and shoe of FIG. 9, showing the spat fastened to the shoe.

As shown in FIG. 12, after fastening, the spat 110 has a top opening 138 to allow the user's leg to extend therethrough and a bottom opening 139 to receive the cleats 24 therethrough, similarly to the spat 10 described above. Also similar to the spat 10 described above, the sleeve 118 has a top opening 140 that wraps around the upper portion 143 of the boot portion 114 and a bottom opening 142 that is substantially aligned with the bottom opening 139 of the boot portion 114 to allow the cleats 24 to pass through the bottom of the spat 110. It is understood that the spat 110 can be worn by an athlete without the use of the additional band 150. It is also understood that the band 150 could be incorporated into the spat 10 shown in FIGS. 1-8.

Other features of the spat 110 of FIGS. 9-12 are similar to those of the spat 10 described above, and the additional or alternate features in the various embodiments of the spat 10 described above may be utilized with the spat 110 of FIGS. 9-12. For example, any of the customizable features of the spat disclosed above may be incorporated into the spat 110. Additionally, any of the materials suitable for use with the embodiments described above may be used with various embodiments of the spat 110 of FIGS. 9-12.

Referring to FIGS. 13-16, a third embodiment of a removable spat 210 for use with a shoe 12 is shown. The spat 210 contains many features similar to the features of the spats 10, 110 described above and shown in FIGS. 1-8 and 9-12, respectively, and such similar features are similarly referred to using the "200" series of reference numerals. Accordingly, the similar features of the spat 210 are only briefly described herein, and the spat 210 is described in greater detail with respect to the differences from the spats 10, 110 previously described. The shoe 12 shown in FIGS. 13-16 is considered to be similar to the shoe 12 described above, and the features of the shoe 12 are referred to in the same manner.

Figure 13:
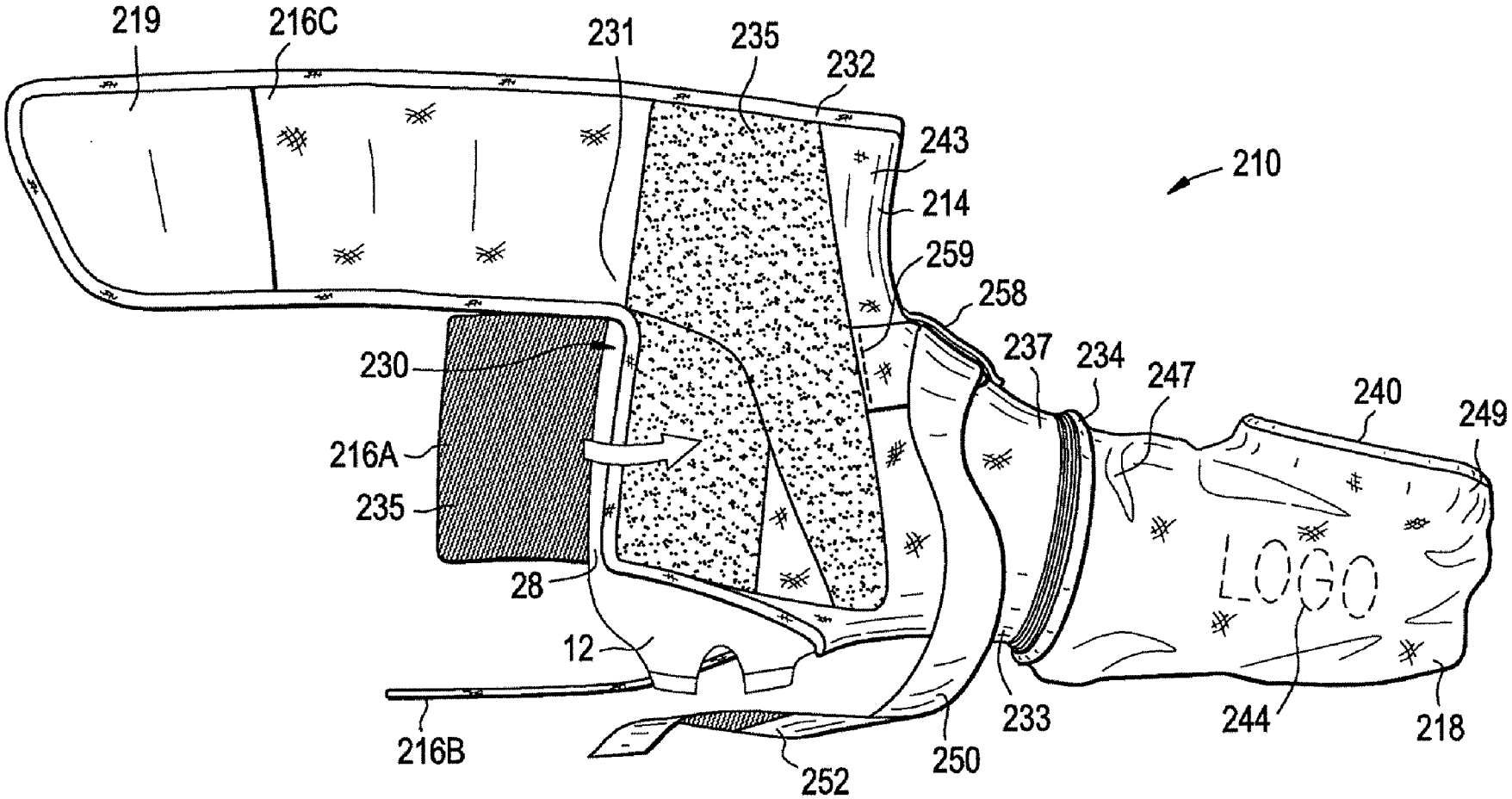
FIG. 13 is side view of a third embodiment of a removable spat, showing steps in a process of fastening the spat to a shoe.
Figure 14:
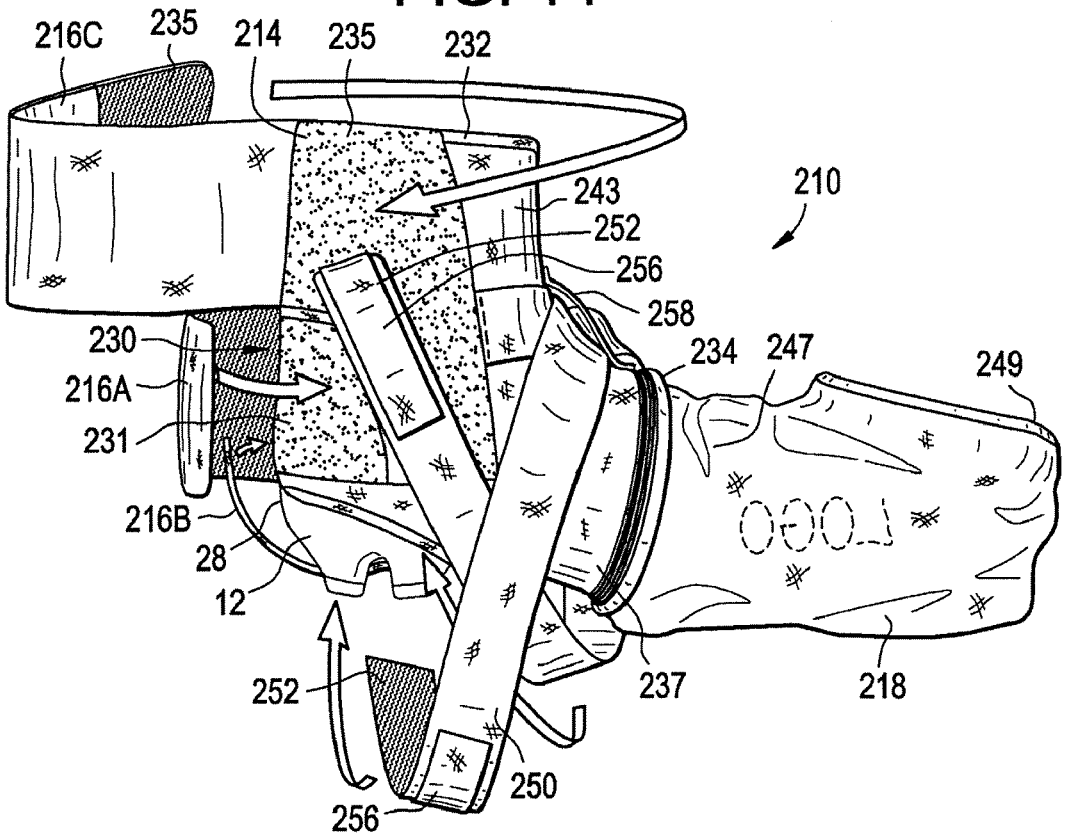
FIG. 14 is a side view of the spat and shoe of FIG. 13, showing further steps in the process of fastening the spat to the shoe.

As described above, the exemplary embodiment of the spat 210 illustrated in FIGS. 13-16 has a boot portion 214 that includes a plurality of straps 216 and a sleeve 218 connected to the boot portion 214. The boot portion 214 includes a rear strap 216A, a bottom strap 216B, and a top strap 216C, as well as various hook and loop fastener portions 235 for releasably fastening the straps 216. It can be observed from the drawings that in the embodiment of FIGS. 13-16, the rear strap 216A is larger and wider than the rear strap 16A of the spat 10 of FIGS. 1-8, similar to the rear strap 116A of the spat 110 of FIGS. 9-12. Additionally, the bottom strap 216B is narrower than the bottom strap 16B of the spat 10 of FIGS. 1-8, and does not contain a widened portion or wings 36, also similar to the spat 110 of FIGS. 9-12. However, the bottom strap 216B of the spat 210 of FIGS. 13-16 is designed to be fastened below the rear strap 216A, as shown in FIG. 14 and described below. The top strap 216C generally has a similar configuration as the top straps 16C, 116C described previously. The sleeve 218 also has a similar configuration as the sleeves 18, 118 described previously, being attached to the front 237 of the boot portion 214 around the front opening 234 thereof.

In the exemplary embodiment of FIGS. 13-16, the spat 210 also includes an additional strap, in the form of a band 250 that wraps around the boot portion 214 to provide additional compression to the spat 210. In one embodiment, the band 250 is made of a low-stretch, high-strength material to provide greater compression and stability. The band 250 shown in FIGS. 13-16 includes hook and loop fastener portions 235 at the free ends 252 for fastening the free ends 252 to the boot portion 214, similarly to the band 150 of the spat 110 of FIGS. 9-12. Also like the band 150 described above, the band 250 has material loops 256 sewn onto the free ends 252, to permit a user to grip the band 250 and pull the band 250 tighter, for achieving greater compression. The boot portion 214 has a loop 258 proximate the front opening 234, and the band 250 is threaded through the loop 258 to hold the band 250 in place. However, unlike the band 150 described above, the band 250 of the spat 210 of FIGS. 13-16 is not separable from the boot portion 214, and is sewn to the boot portion 214 on either side of the loop 258, at stitch lines 259. The band 250 also does not extend around the rear 231 of the boot portion 214, and only extends around the front and sides of the boot portion 114.

Figure 15:
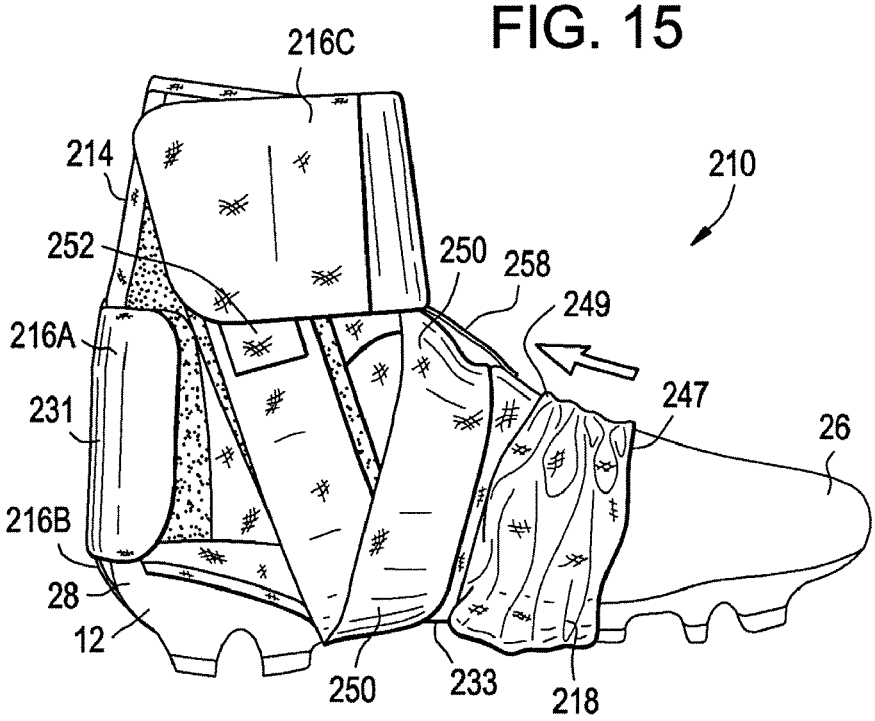
FIG. 15 is a side view of the spat and shoe of FIG. 13, showing a sleeve being folded backward over the shoe.

The spat 210 is fastened to the shoe 12 in a manner similar to that described above with respect to the spat 10 of FIGS. 1-8 and the spat 110 of FIGS. 9-12. First, the shoe 12 is inserted into the rear opening 230 of the boot portion 214, as shown in FIG. 13, and the toe 26 of the shoe 12 protrudes from the front opening 234. As shown in FIG. 14, the bottom strap 216B is pulled across the sole 20 of the shoe 12 and vertically up the rear opening 230 and up the heel 28 of the shoe 20, and the rear strap 216A is then fastened across the heel 28 of the shoe 12, across the rear opening 230 of the boot portion 214, and across the bottom strap 216B. The bottom strap 216B has a hook and loop fastener portion 235 on the outer surface thereof in order to be fastened to the hook and loop fastener portion 235 on the inner surface of the rear strap 216A. Like the bottom strap 16B described above and shown in FIG. 3, the bottom strap 216B extends through the spaces 25 between the cleats 24 on the sole 20 of the shoe 12. After the rear strap 216A and bottom strap 216B are fastened, the band 250 is wrapped around the boot portion 214. As shown in FIGS. 14-15, the free ends 252 of the band 250 are wrapped around the bottom portion 233 of the boot portion 214 and up the sides of the boot portion 214, where the free ends 252 are fastened, as shown in FIG. 15. The top strap 216C is then wrapped around the top 232 of the boot portion 214 and is fastened upon itself, in the same manner as described above. After the straps 216, 250 have been wrapped to the desired tightness and fastened, the free end 249 of the sleeve 218 is pulled backward over the boot portion 214, as shown in FIG. 15, in the same manner as described above.

Figure 16:
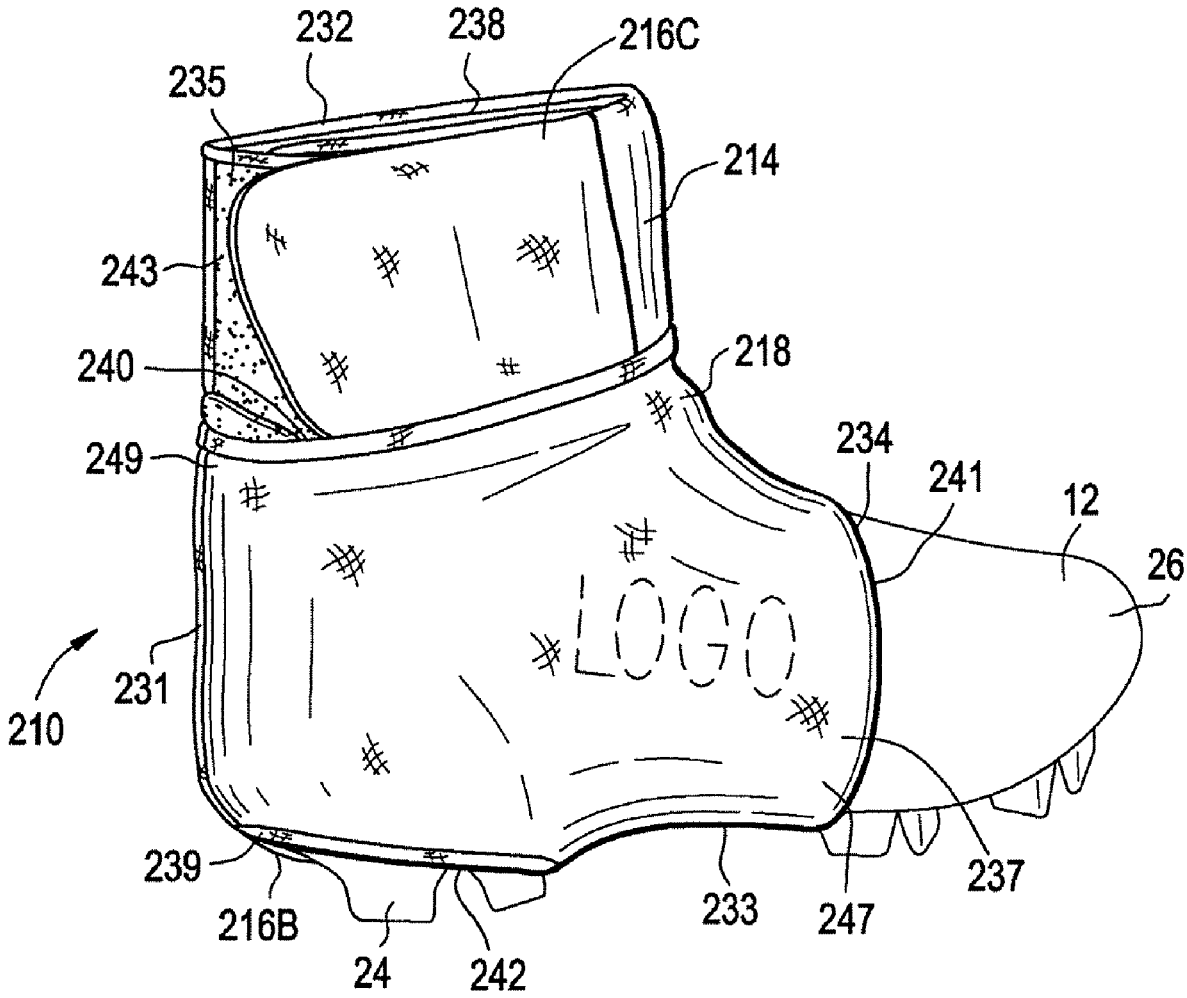
FIG. 16 is a side view of the spat and shoe of FIG. 13, showing the spat fastened to the shoe.

As shown in FIG. 16, after fastening, the spat 210 has a top opening 238 to allow the user's leg to extend therethrough and a bottom opening 239 to receive the cleats 24 therethrough, as illustrated in FIG. 16, similarly to the spats 10, 110 described above. Also similar to the spats 10, 110 described above, the sleeve 218 has a top opening 240 that wraps around the upper portion 243 of the boot portion 214 and a bottom opening 242 that is substantially aligned with the bottom opening 239 of the boot portion 214 to allow the cleats 24 to pass through the bottom of the spat 210.

Other features of the spat 210 of FIGS. 13-16 are similar to those of the spats 10, 110 described above, and the additional or alternate features in the various embodiments of the spats 10, 110 described above may be utilized with the spat 210 of FIGS. 13-16. For example, any of the customizable features of the spat disclosed above may be incorporated into the spat 210. Additionally, any of the materials suitable for use with the embodiments described above may be used with various embodiments of the spat 210 of FIGS. 13-16.

Referring to FIGS. 17-21, a fourth embodiment of a removable spat 310 for use with a shoe 12 is shown. The spat 310 contains some features similar to the features of the spats 10, 110, 210 described above and shown in FIGS. 1-8, 9-12, and 13-16, respectively, and such similar features are similarly referred to using the "300" series of reference numerals.

The spat 310 shown in FIGS. 17-21 generally includes a boot portion 314 having a bottom portion 333, a top 332, a rear 331, and a front 337 with a front opening 334. The boot portion 314 has two separate straps, including a forefoot strap 360 and a rear strap or heel strap 370, which are fastened around the shoe 12 to secure the spat 310 to the shoe 12 and to provide compression. The shoe 12 shown in FIGS. 17-21 is considered to be similar to the shoe 12 described above, and the features of the shoe 12 are referred to in the same manner.

Figure 19:
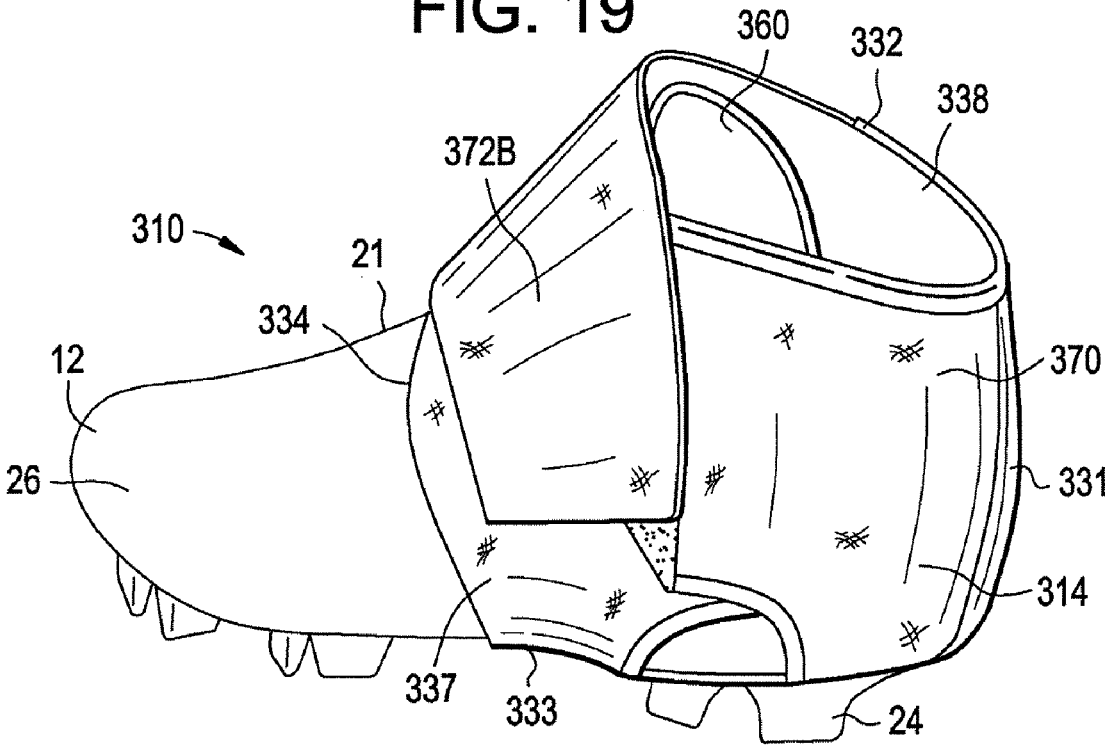
FIG. 19 is a side view of the spat of FIG. 17, showing the spat fastened to the shoe.
Figure 20:
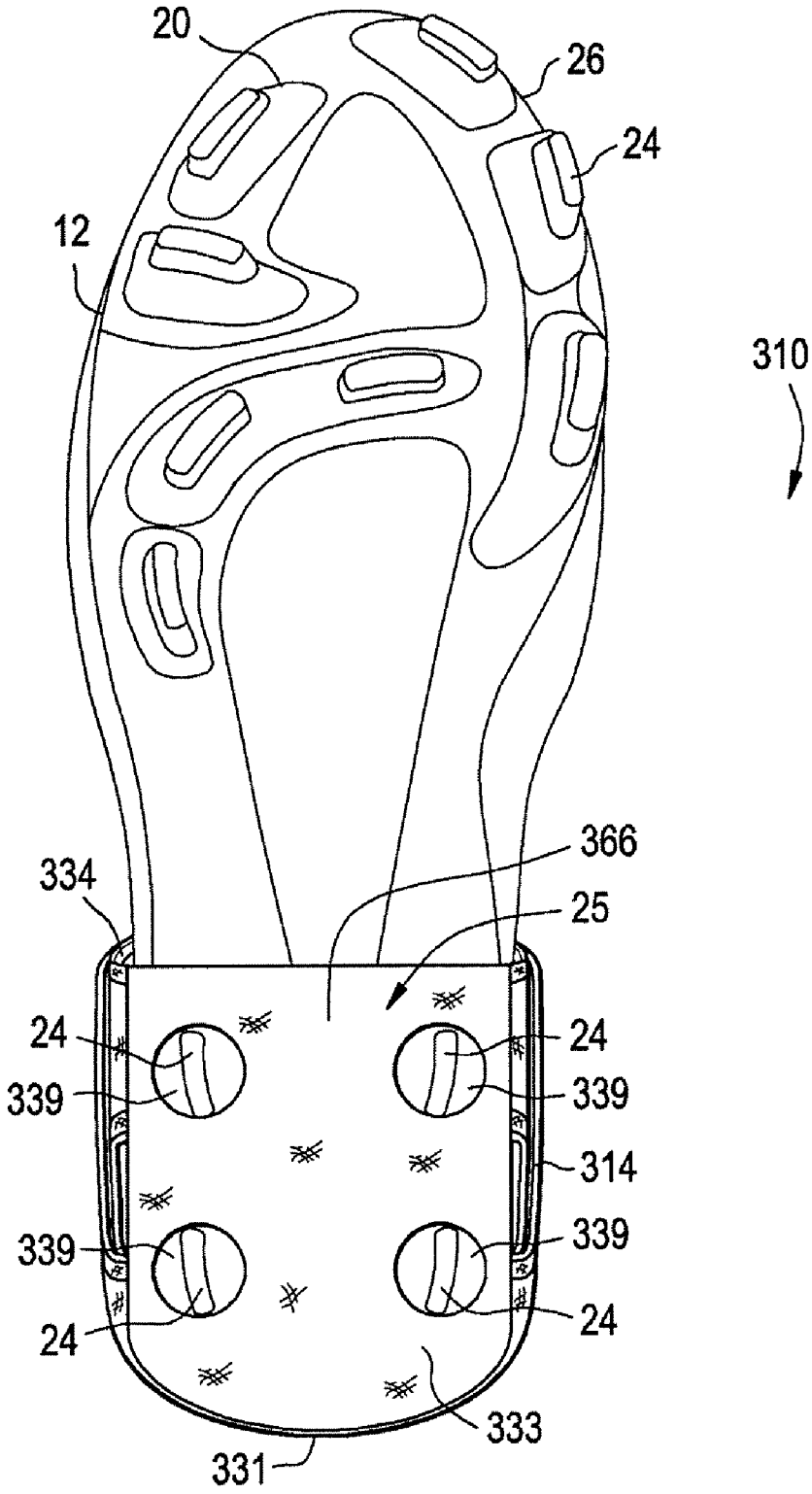
FIG. 20 is a bottom view of the spat and shoe of FIG. 17.
Figure 21:
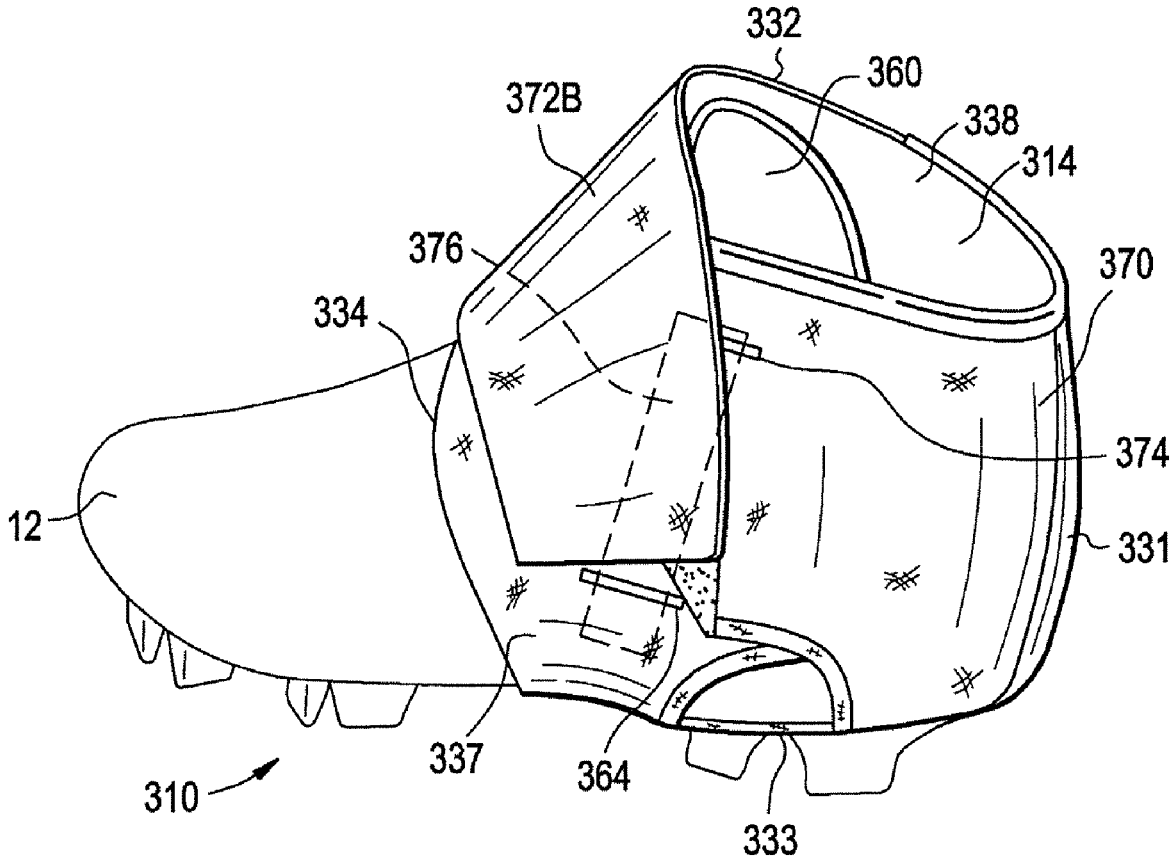
FIG. 21 is a side view of the spat and shoe of FIG. 17, having a stiffening element inserted therein.

As best illustrated in FIG. 20, the bottom portion 333 covers a portion of the sole 20 of the shoe 12 proximate the heel 28, and has openings 339 therein to receive the cleats 24 therethrough. In the embodiment of FIGS. 17-21, the openings 339 are sized to each receive an individual cleat 24 of the shoe 12, and the bottom portion 333 has central portions 366 that extend through the spaces 25 between the cleats 24. The spat 310 is suitable for use with the shoe 12 illustrated, which includes four rear cleats 24, and thus, the spat 310 includes four openings 339 to receive the cleats 24. In other embodiments, which may be suitable for use with the shoe 12 disclosed above and/or different types of shoes having a different number or arrangement of rear cleats 24, the bottom portion 333 may contain a different number or arrangement of openings 339 therein. In one embodiment, the bottom portion 333 is made from a strong, durable, low stretch material, to provide a secure base for fastening the spat 310 and to absorb the abuse that the bottom portion 333 may encounter during use. The bottom portion 333 may further include a coating thereon for durability purposes, as described above. As another example, if desired, the bottom portion may be provided with traction elements or even with cleats.

The forefoot strap 360 and the rear strap 370 are connected to the bottom portion 333 and wrap around the upper 22 of the shoe 12. In one embodiment, the bottom portion 333 is made from a low-stretch material, and the straps 360, 370 are made from a more elastic material than the bottom portion 333, to enable wrapping and controllable compression in a similar manner to the embodiments described above. Additionally, the forefoot and rear straps 360, 370 may contain indicia (not shown) other additional or alternate features in the various embodiments of the spats 10, 110, 210 described above, including the customizable features described above. Further, any of the materials suitable for use with the embodiments described above may be used with various embodiments of the spat 310 of FIGS. 17-21.

Figure 17:
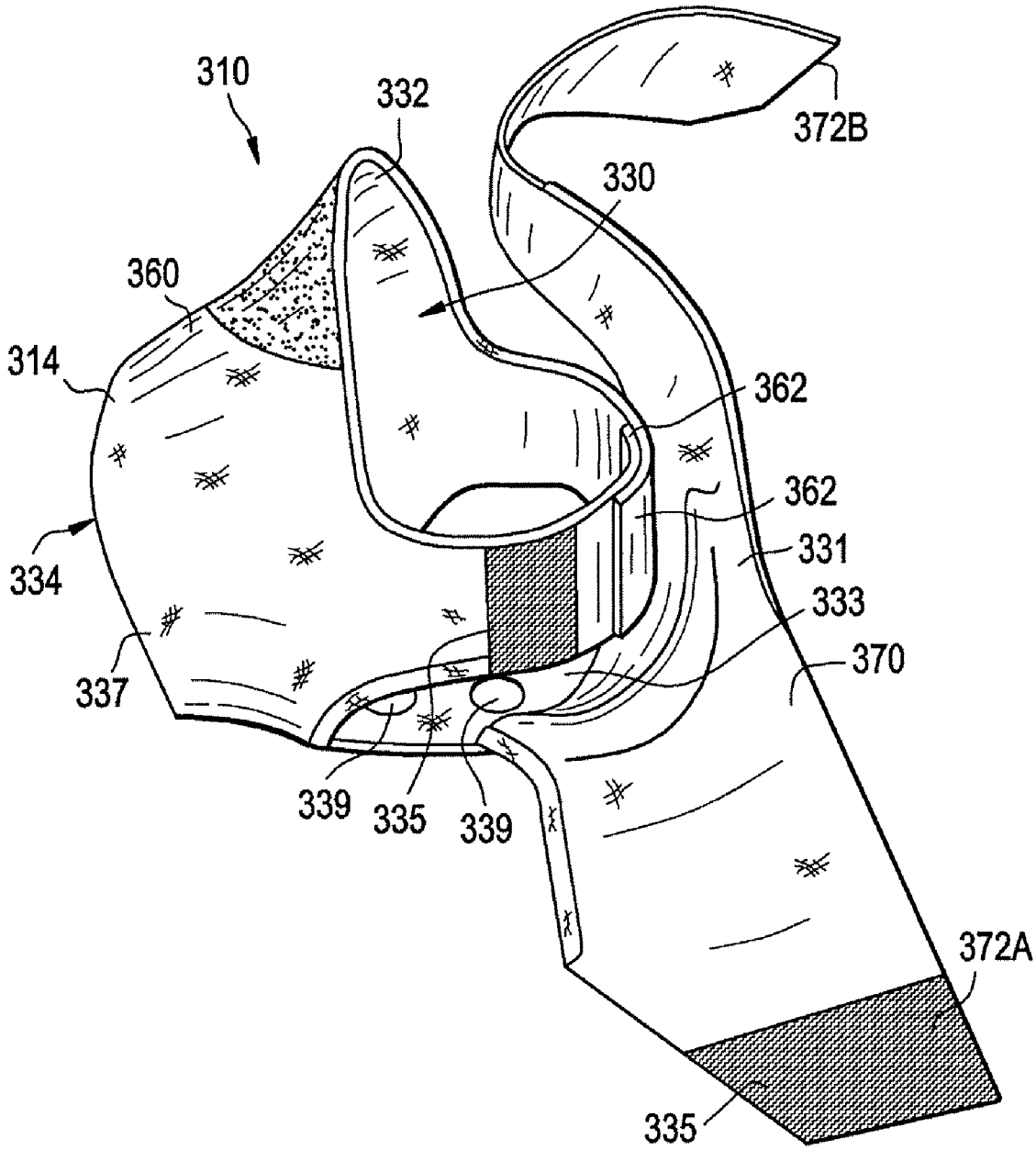
FIG. 17 is a side view of a fourth embodiment of a removable spat.

In the embodiment shown in FIGS. 17-21, the forefoot strap 360 has a "stirrup" configuration, and is adapted to receive the forefoot 21 of the upper 22 of the shoe 12. The forefoot strap 360 has a front opening 334 and a rear opening 330 therein, adapted to receive the shoe 12 therethrough. In the embodiment shown, the forefoot strap 360 is attached to the bottom portion 333 proximate the front 337 of the spat 310 and has two free ends 362 adapted to be wrapped and fastened around the heel 28 of the shoe 12. The connection of the free ends 362 is shown in FIG. 17, and, in the embodiment illustrated, the free ends 362 are fastened together by hook and loop fastener portions 335.

Figure 18:
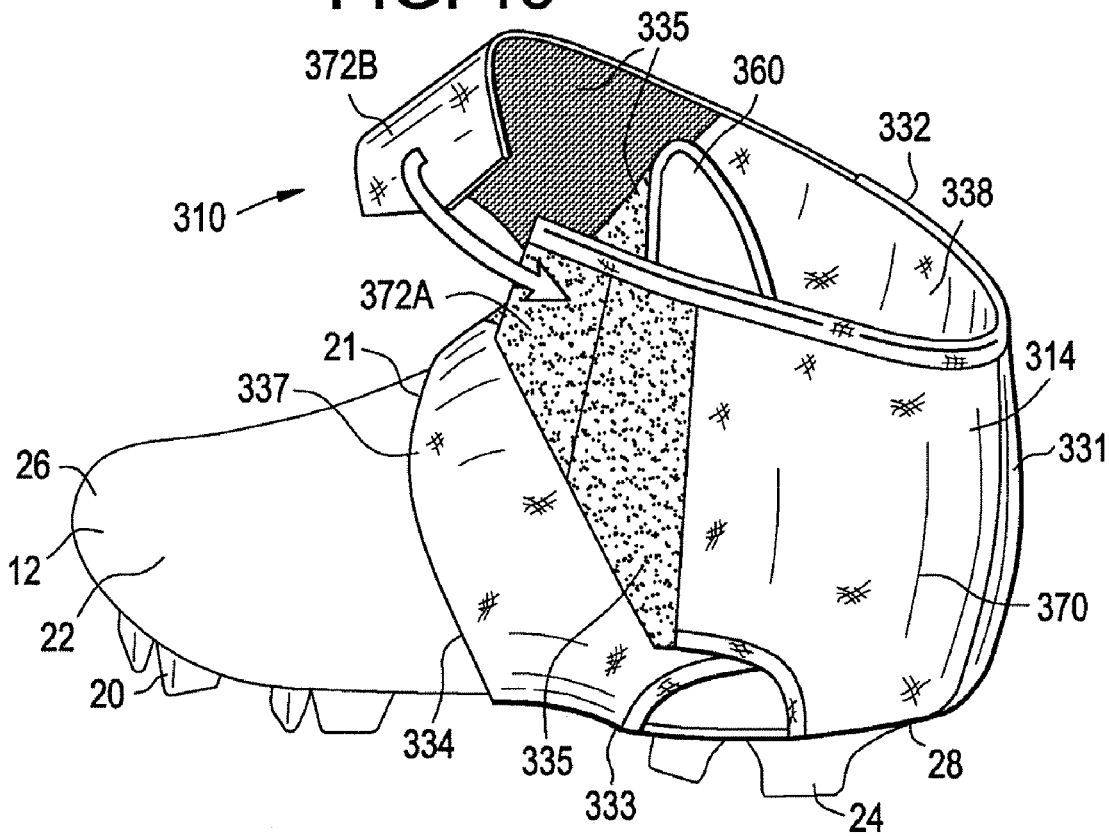
FIG. 18 is a side view of the spat of FIG. 17, showing steps in a process of fastening the spat to a shoe.

In the embodiment shown in FIGS. 17-21, the rear strap 370 is attached to the bottom portion 333 proximate the rear 331 of the spat 310 and has two free ends 372 adapted to be wrapped and fastened around the forefoot 21 of the shoe 12. The connection of the free ends 372 is illustrated in FIGS. 17-19, and, in the embodiment illustrated, the free ends 372 are fastened together by hook and loop fastener portions 335. As shown in FIGS. 18-19, when the rear strap 370 is fastened in position, the rear opening 330 of the forefoot strap 362 is covered by the rear strap 370, and the free ends 372 of the rear strap 370 fasten over the top of the forefoot strap 360 and over the forefoot 21 of the shoe 12. In one embodiment, the forefoot strap 360 may include a loop or slot (not shown) that receives one of the free ends 372 of the rear strap 370 therethrough, to provide a more secure connection.

In the exemplary embodiment illustrated in FIGS. 17-21, fastening the spat 310 to the shoe 12 is done by first inserting the shoe 12 (typically while worn on the foot of the user) into the rear opening 330 of the forefoot strap 360, and fastening the free ends 362 of the forefoot strap 360 around the heel 28 of the shoe 12. The shoe 12 should be positioned so that the cleats 24 near the heel 28 of the shoe 12 extend through the openings 339 in the bottom portion 333, as shown in FIG. 20. One of the free ends 372A of the rear strap 370 is then fastened to the forefoot strap 360, as shown in FIG. 18, and the other free end 372B is fastened over the top of the first free end 372A, as shown in FIGS. 18-19. When both the forefoot strap 360 and the rear strap 370 are pulled to the desired tightness and fastened, as shown in FIG. 19 the shoe 12 and spat 310 are ready for use.

In some embodiments, the spat 310 may include an internal stiffening element, or may be adapted to support a stiffening element to give more lateral ankle support and protection. In one such embodiment, illustrated in FIG. 21, the rear strap 370 has a slot 374 therein to receive a stiffening element, such as a carbon fiber composite shaft 376, shown in broken lines in FIG. 21. The forefoot strap 360 also has a slot 364 therein to receive the stiffening element 376, so that the stiffening element 376 can extend a greater distance over the ankle of the wearer. Other structures and techniques for including stiffening elements may be used with this embodiment, or the other various embodiments of spats 10, 110, 210 described herein.

Several embodiments of the removable spat 10, 110, 210, 310 have been described herein. The various designs of the spats have several different structures and features. It is understood that the various features can be combined in different spat configuration as desired by a wearer.

The various embodiments of the removable spat 10, 110, 210, 310 described herein provide benefits and advantages not provided by existing athletic support equipment. The spat can be used to provide foot and ankle support as a replacement for traditional ankle taping, or in addition to ankle taping to provide additional support. Unlike ankle tape, the tightness of the spat can be quickly and easily adjusted at will, such as by an athlete or a trainer during competition. In addition, the compressive forces provided by the spat can provide better support not realized through conventional taping. The various customizable features of the spat described herein provide adaptability not obtainable by prior footwear or support equipment. The spat further provides space for placement of a logo or other indicia that may be covered by ankle tape if placed directly on a shoe. As discussed, the sleeve or other portions of the spat can be provided with additional functional characteristics not achievable when shoes are substantially covered in tape. Further benefits and advantages will be recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A removable spat for use with a shoe comprising a sole and an upper, the spat comprising:

a boot portion adapted to receive at least a heel portion of the shoe therein, the boot portion having a front end and a back opening adapted to receive the shoe therein, the boot portion further comprising:

a first strap releasably fastenable laterally across the back opening and around a heel of the shoe when the shoe is adapted to be received in the boot portion;

a second strap releasably fastenable from a bottom of the boot portion vertically over the back opening and across a portion of the sole of the shoe when the shoe is adapted to be received in the boot portion; and a third strap releasably fastenable around a top of the boot portion; and a sleeve having a fixed end connected to the front end of the boot portion and a free end opposite the fixed end, the sleeve extending freely from the front end to define a first sleeve position, and the sleeve being extendable over at least some of the boot portion to define a second sleeve position.

2. The removable spat of claim 1, wherein the sleeve has a first opening and a second opening therein, wherein when the sleeve is in the second position, an upper portion of the boot portion extends through the first opening, and the second opening is adapted to receive at least one cleat of the shoe sole therethrough.

3. The removable spat of claim 1, further comprising a band connected to the boot portion and releasably fastenable around the boot portion to provide compression thereto.

4. The removable spat of claim 1, wherein the sleeve is made of a waterproof material.

5. The removable spat of claim 1, wherein the sleeve has a textural coating on at least a portion thereof.

6. The removable spat of claim 1, wherein the sleeve has a reflective portion.

7. The removable spat of claim 1, wherein the sleeve is made of a breathable material.

8. The removable spat of claim 1, wherein the sleeve is made of a resiliently flexible material adapted to provide compression to the shoe when in the second sleeve position.

9. The removable spat of claim 1, wherein the sleeve contains an insulation material adapted to insulate the shoe.

10. The removable spat of claim 1, wherein the sleeve has indicia thereon that is visible when the sleeve is in the second position.

11. A removable spat for use with a shoe comprising a sole and an upper, the spat comprising:

a boot portion having a front opening, the boot portion adapted to wrap around a portion of the shoe to fasten the spat to the shoe such that a toe portion of the shoe extends through the front opening; and a sleeve having a fixed end attached to the boot portion and a free end not attached to the boot portion, wherein the sleeve is movable from a first position, wherein the free end of the sleeve extends outwardly from the boot portion, to a second position, wherein the sleeve extends so as to wrap around the boot portion and cover at least a portion of the boot portion, wherein the sleeve has a first opening and a second opening therein, and wherein when the sleeve is in the second position, an upper portion of the boot portion extends through the first opening, and the second opening is adapted to receive at least one cleat of the shoe sole therethrough.

12. The removable spat of claim 11, wherein the fixed end of the sleeve is attached to the boot portion around the front opening.

13. A removable spat for use with a shoe comprising a sole and an upper, the spat comprising:

a boot portion adapted to receive at least a heel portion of the shoe therein, the boot portion having a front end; and a sleeve having a fixed end connected to the front end of the boot portion and a free end opposite the fixed end, the sleeve extending freely from the front end to define a first sleeve position, and the sleeve being extendable over at least some of the boot portion to define a second sleeve position, wherein the sleeve has a first opening and a second opening therein, and wherein when the sleeve is in the second position, an upper portion of the boot portion extends through the first opening, and the second opening is adapted to receive at least one cleat of the shoe sole therethrough.

14. The removable spat of claim 13, wherein the boot portion has a back opening adapted to receive the shoe therein.

15. The removable spat of claim 14, wherein the boot portion further comprises:

a first strap releasably fastenable laterally across the back opening and around a heel of the shoe when the shoe is adapted to be received in the boot portion;

a second strap releasably fastenable from a bottom of the boot portion vertically over the back opening and across a portion of the sole of the shoe when the shoe is adapted to be received in the boot portion; and a third strap releasably fastenable around a top of the boot portion.

16. The removable spat of claim 13, further comprising a band connected to the boot portion and releasably fastenable around the boot portion to provide compression thereto.

17. The removable spat of claim 13, wherein the sleeve is made of a waterproof material.

18. The removable spat of claim 13, wherein the sleeve has a textural coating on at least a portion thereof.

19. The removable spat of claim 13, wherein the sleeve has a reflective portion.

20. The removable spat of claim 13, wherein the sleeve is made of a breathable material.

21. The removable spat of claim 13, wherein the sleeve is made of a resiliently flexible material adapted to provide compression to the shoe when in the second sleeve position.

22. The removable spat of claim 13, wherein the sleeve contains an insulation material adapted to insulate the shoe.

23. The removable spat of claim 13, wherein the sleeve has indicia thereon that is visible when the sleeve is in the second position.

24. A removable spat for use with a shoe comprising a sole and an upper, the spat comprising:

a boot portion having a front opening, the boot portion adapted to wrap around a portion of the shoe to fasten the spat to the shoe such that a toe portion of the shoe extends through the front opening; and a sleeve having a fixed end attached to the boot portion and a free end not attached to the boot portion, wherein the sleeve is movable from a first position, wherein the free end of the sleeve extends outwardly from the boot portion, to a second position, wherein the sleeve extends so as to wrap around the boot portion and cover at least a portion of the boot portion, wherein the boot portion has an opening at a bottom thereof, and wherein the opening is adapted to receive at least one cleat of the shoe sole therethrough, and wherein the sleeve has an opening therein, and wherein when the sleeve is in the second position, the sleeve opening is substantially aligned with the opening of the boot portion and is adapted to receive at least one cleat of the shoe sole therethrough.

25. The removable spat of claim 24, wherein the fixed end of the sleeve is attached to the boot portion around the front opening.

* * * * *